US012006609B2

(12) United States Patent
Kessler et al.

(10) Patent No.: US 12,006,609 B2
(45) Date of Patent: Jun. 11, 2024

(54) DETERMINING A STATE OF A DOMESTIC APPLIANCE

(71) Applicant: Henkel AG & Co. KGaA, Duesseldorf (DE)

(72) Inventors: Arnd Kessler, Monheim am Rhein (DE); Lars Zuechner, Langenfeld (DE); Robert Ruiz Hernandez, Duesseldorf (DE); Ingo Hardacker, Hamminkeln (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 946 days.

(21) Appl. No.: 16/975,971

(22) PCT Filed: Mar. 7, 2019

(86) PCT No.: PCT/EP2019/055743
§ 371 (c)(1),
(2) Date: Aug. 26, 2020

(87) PCT Pub. No.: WO2019/170819
PCT Pub. Date: Sep. 12, 2019

(65) Prior Publication Data

US 2021/0040667 A1 Feb. 11, 2021

(30) Foreign Application Priority Data

Mar. 9, 2018 (DE) ..... 10 2018 203 588.1

(51) Int. Cl.
*D06F 33/32* (2020.01)
*D06F 34/05* (2020.01)
(Continued)

(52) U.S. Cl.
CPC ..... *D06F 33/32* (2020.02); *D06F 34/14* (2020.02); *D06F 34/05* (2020.02);
(Continued)

(58) Field of Classification Search
None
See application file for complete search history.

(56) References Cited

U.S. PATENT DOCUMENTS

2003/0182732 A1 10/2003 Davenet et al.
2004/0088796 A1 5/2004 Neergaard et al.
(Continued)

FOREIGN PATENT DOCUMENTS

DE 102007042863 A1 3/2009
DE 102009002693 A1 1/2010
(Continued)

OTHER PUBLICATIONS

EPO, International Search Report issued in International Application No. PCT/EP2019/055743, dated Apr. 17, 2019.

*Primary Examiner* — Rita P Adhlakha
(74) *Attorney, Agent, or Firm* — Lorenz & Kopf, LLP

(57) ABSTRACT

A method is disclosed comprising inter alia a method comprising: acquiring at least one set of sensor data, wherein the at least one set of sensor data is acquired from at least one sensor; determining evaluation data indicative of a condition of a treatment chamber of a household appliance, wherein the evaluation data is determined based at least in part on the acquired set of sensor data; and outputting or causing the output of the determined evaluation data. Furthermore, a device for executing and/or controlling this method, a system with several devices for controlling and/or executing this method and a computer program for executing and/or controlling this method are disclosed.

14 Claims, 8 Drawing Sheets

(51) Int. Cl.

| | |
|---|---|
| ***D06F 34/14*** | (2020.01) |
| ***D06F 103/00*** | (2020.01) |
| ***D06F 103/24*** | (2020.01) |
| ***D06F 103/26*** | (2020.01) |
| ***D06F 103/68*** | (2020.01) |
| ***D06F 105/42*** | (2020.01) |

(52) U.S. Cl.
CPC ..... *D06F 2103/00* (2020.02); *D06F 2103/24* (2020.02); *D06F 2103/26* (2020.02); *D06F 2103/68* (2020.02); *D06F 2105/42* (2020.02)

(56) References Cited

U.S. PATENT DOCUMENTS

| | | | | |
|---|---|---|---|---|
| 2016/0231723 | A1* | 8/2016 | Pietsch | A47L 15/0063 |
| 2018/0258571 | A1* | 9/2018 | Nishino | D06F 37/245 |

FOREIGN PATENT DOCUMENTS

| | | | |
|---|---|---|---|
| WO | 2009033828 | A1 | 3/2009 |
| WO | 2011134690 | A1 | 11/2011 |
| WO | 2017067936 | A1 | 4/2017 |
| WO | 2017167658 | A1 | 10/2017 |

* cited by examiner

DETERMINING A STATE OF A DOMESTIC APPLIANCE

CROSS-REFERENCE TO RELATED APPLICATION

This application is a U.S. National-Stage entry under 35 U.S.C. § 371 based on International Application No. PCT/EP2019/055743, filed Mar. 7, 2019, which was published under PCT Article 21(2) and which claims priority to German Application No. 10 2018 203 588.1, filed Mar. 9, 2018, which are all hereby incorporated in their entirety by reference.

TECHNICAL FIELD

Exemplary embodiments of the present disclosure concern the determination of evaluation data, for example to determine a condition of a treatment chamber of a household appliance.

BACKGROUND

Devices and methods for controlling and/or regulating household appliances such as washing machines or tumble dryers are known from the state of the art. The aim in operating such household appliances is typically to achieve a high degree of user-friendliness and at the same time the best possible result (in the case of a washing machine, in particular, the most immaculate cleaning result possible).

If, for example, increased soiling is to be taken into account, a user must take this into account manually, for example, and select an appropriate program or detergent. Approaches are known in which parameters of the household appliance are automatically adjusted before executing a cleaning program in order to achieve the best possible result. For example, parameters of the household appliance are configured to parameters defined by the detergent used. Therefore, for example, the washing program of a washing machine is configured to the detergent used.

The disadvantage is that in many situations and scenarios the result to be achieved is still in need of improvement.

BRIEF SUMMARY

Devices and methods for acquiring sensor data, determining evaluation data, and outputting the evaluation data are provided. In an exemplary embodiment, a method includes acquiring the sensor data by a sensor, wherein the sensor data at least partially represents a progression of data over a predetermined time interval. The progression represented by the sensor data maps a curve progression over the predetermined time interval. Evaluation data is determined that is indicative of a treatment chamber of a household appliance, where the evaluation data is based at least in part on the sensor data. Determining the evaluation data further includes determining a characteristic pattern mapped by the curve progression. The evaluation data is output. A device includes features to perform the method.

BRIEF DESCRIPTION OF THE DRAWINGS

The present disclosure will hereinafter be described in conjunction with the following drawing figures, wherein like numerals denote like elements, and.

DETAILED DESCRIPTION

Figure 1:
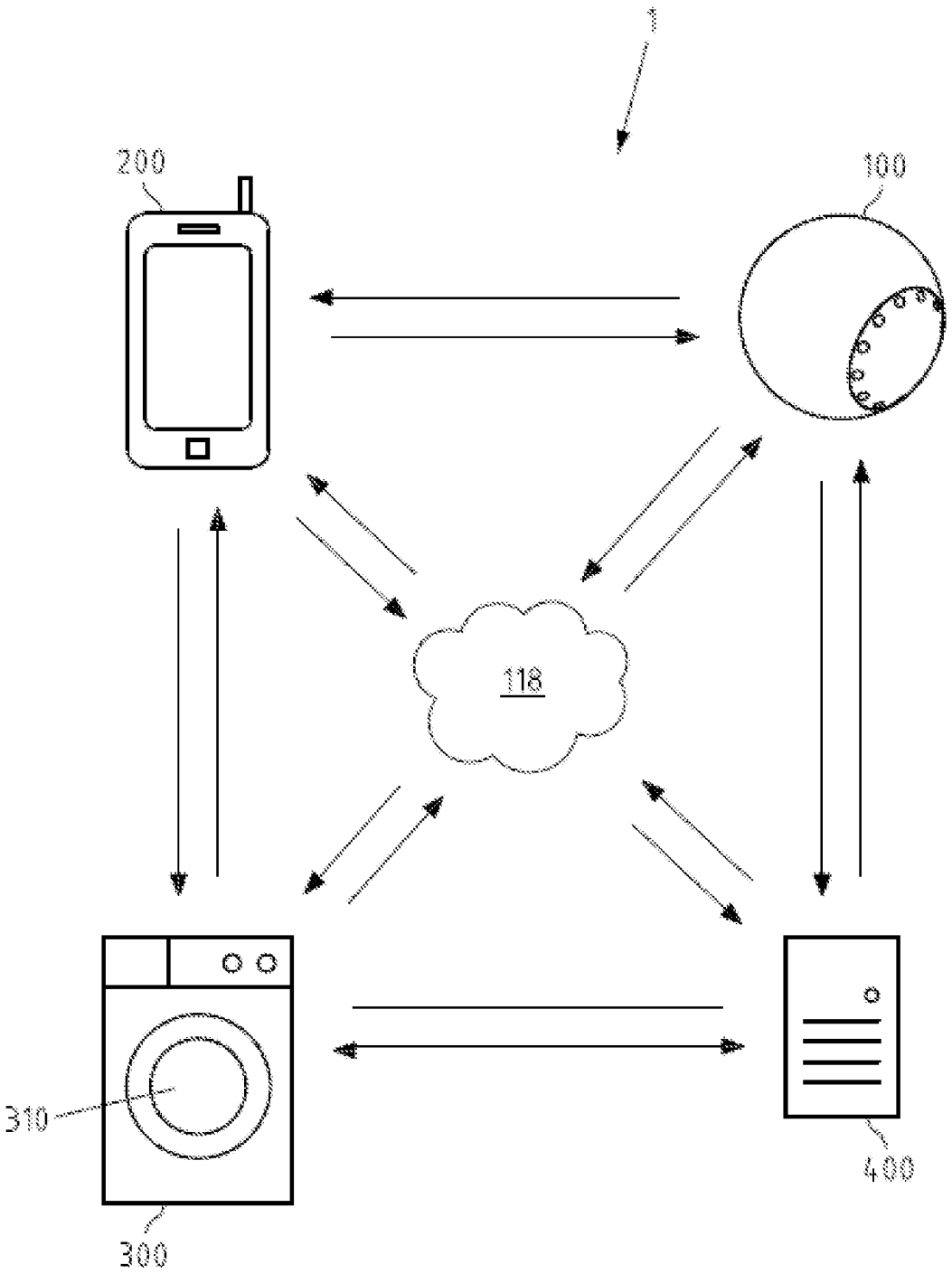
FIG. 1 shows a schematic representation of an embodiment of a system as contemplated herein.

The following detailed description is merely exemplary in nature and is not intended to limit the disclosure or the application and uses of the subject matter as described herein. Furthermore, there is no intention to be bound by any theory presented in the preceding background or the following detailed description.

Against the background of the state of the art as presented, the task of the present disclosure is to variably improve the result to be achieved with a household appliance with respect to the many possible situations and scenarios and to ensure the highest possible reliability of the devices used.

According to a first aspect of the present disclosure, a method is described, performed by at least one first device comprising:

acquiring at least one set of sensor data, wherein the at least one set of sensor data is acquired by at least one sensor;

determining one set of evaluation data indicative of a condition of a treatment chamber of a household appliance, wherein the evaluation data is determined at least in part based on the acquired sensor data; and outputting or causing the output of the specific evaluation data.

This method may, for example, be executed and/or controlled by a device, e.g. a dosing device or a device that may also be placed in the treatment chamber of the household appliance.

For the purposes of the present disclosure, "household appliance" means household appliances for textile treatment, in particular textile washing machines, tumble dryers or ironing devices. Dishwashing appliances, such as dishwashers, are not household appliances within the meaning of the present disclosure.

According to a second aspect of the present disclosure, a device is disclosed, in particular for use in a household appliance, the device being configured or comprising corresponding components to execute and/or control a method according to the first aspect. Devices of the method according to the first aspect of the present disclosure are or comprise in particular one or more devices according to this second aspect of the present disclosure.

According to the second aspect of the present disclosure, a device is disclosed for use in a household appliance, wherein the device is configured or comprises corresponding components to execute and/or control a method according to the first aspect. Devices of the method according to the first aspect of the present disclosure are or comprise in particular one or more devices according to this second aspect of the present disclosure.

The device according to the second aspect of the present disclosure is, for example, a dosing device for dispensing a preparation comprising treatment agents, fragrances, detergents and/or cleaning agents. The device according to the second aspect of the present disclosure is for example a sensor device for detecting sensor data concerning the treatment process (e.g. cleaning program) in the household appliance. The device according to the second aspect of the present disclosure is, for example, a dosing device in combination with a sensor device comprising, for example, one acceleration sensor, in particular in a common casing.

Alternatively or additionally, the components of the device according to the second aspect may further comprise one or more sensors and/or one or more communication interfaces.

A communication interface is to be understood, for example, as a wireless communication interface and/or a wired communication interface.

A wireless communication interface is, for example, a communication interface according to a wireless communication technology. An example of a wireless communication technology is a local radio network technology such as Radio Frequency Identification (RFID) and/or Near Field Communication (NFC) and/or Bluetooth (e.g. Bluetooth version 2.1 and/or 4.0) and/or Wireless Local Area Network (WLAN). RFID and NFC, for example, are specified according to ISO standards 18000, 11784/11785 and IS O/IEC standards 14443-A and 15693. WLAN, for example, is specified in the standards of the IEEE 802.11 family Another example of a wireless communication technology is a supra-local radio network technology such as a mobile radio technology, for example Global System for Mobile Communications (GSM) and/or Universal Mobile Telecommunications System (UMTS) and/or Long Term Evolution (LTE). The GSM, UMTS and LTE specifications are maintained and developed by the 3rd Generation Partnership Project (3GPP).

A wired communication interface is, for example, a communication interface according to a wired communication technology. Examples of a wired communication technology are a Local Area Network (LAN) and/or a bus system, for example a Controller Area Network bus (CAN bus) and/or a Universal Serial Bus (USB). CAN bus, for example, is specified according to ISO standard ISO 11898. LAN, for example, is specified in the standards of the IEEE 802.3 family. It is understood that the output module and/or the sensor module may also include other features not listed.

According to the second aspect of the present disclosure, an alternative device is also described, comprising at least one processor and at least one memory containing computer program code, wherein the at least one memory and the computer program code are adapted to execute and/or control with the at least one processor at least one method according to the first aspect. A processor is to be understood, for example, as a control unit, a microprocessor, a microcontrol unit such as a micro-controller, a Digital Signal Processor (DSP), an Application-Specific Integrated Circuit (ASIC) or a Field Programmable Gate Array (FPGA).

An exemplary device, for example, further comprises features for storing data such as a program memory and/or a working memory. For example, an exemplary device as contemplated herein further comprises features for receiving and/or sending data via a network such as a network interface. Exemplary devices as contemplated herein are, for example, interconnected and/or connectable via one or more networks.

An exemplary device according to the second aspect of the present disclosure is or comprises, for example, a data processing system which is configured in terms of software and/or hardware to be able to carry out the respective steps of an exemplary method according to the first aspect of the present disclosure. Examples of data processing equipment are a computer, a desktop computer, a server, a thin client and/or a portable computer (mobile device), such as a laptop computer, a tablet computer, a wearable, a personal digital assistant or a smartphone.

Individual method steps of the method according to the first aspect (for example the acquisition of at least one set of sensor data, e.g. by employing the at least one sensor) may be performed with a sensor device which also has at least one sensor element comprising the at least one sensor. Likewise, individual method steps (for example determining the evaluation data) may be performed by a further device, which is connected to the device in particular via a communication network.

Further devices may be envisaged, for example a server and/or, for example, a part or a component of a server cloud, which provides data processing resources dynamically for different users in a communication system. In particular, a server cloud is understood to be a data processing infrastructure according to the definition of the "National Institute for Standards and Technology" (NIST) for the term "cloud computing".

According to the second aspect of the present disclosure, a computer program is also described which comprises program instructions which cause a processor to execute and/or control a method according to the first aspect when the computer program is executed on the processor. An exemplary program as contemplated herein may be stored in or on a computer-readable storage medium containing one or more programs.

According to the second aspect of the present disclosure, a computer-readable storage medium containing a computer program according to the first aspect is also described. A computer-readable storage medium may, for example, be a magnetic, electrical, electro-magnetic, optical and/or other type of storage medium. Such a computer-readable storage medium is preferably physical (i.e. "touchable"), for example, it is designed as a data storage media device. Such data storage media device is for example portable or permanently installed in a device. Examples of such data storage media device are volatile or non-volatile memories with random access (RAM) like NOR flash memory or with sequential access like NAND flash memory and/or memory with read-only access (ROM) or read-write access. Computer-readable is to be understood, for example, as meaning that the storage medium may be read and/or written by a computer or a data processing system, for example by a processor.

According to a third aspect of the present disclosure, a system is also described comprising several devices, in particular devices according to the second aspect of the present disclosure, such as a dosing device and a server, which together execute and/or control the method according to the first aspect of the present disclosure.

The system further comprises at least one household appliance, for example a washing machine and/or a tumble dryer. The system according to the third aspect may comprise further devices and/or features, for example a communication network and/or a server.

The system may optionally further comprise at least one server or server cloud that executes and/or controls in particular the determination of the evaluation data.

Thereby, at least one device may communicate with the household appliance, in particular wirelessly communicate with the household appliance. In addition, the at least one device may, for example, communicate with the at least one server or the server cloud.

Exemplary features and exemplary embodiments according to all aspects are described in more detail below:

A household appliance is understood to be, in particular, a washing machine, in particular also a (laundry) dryer and/or a washer-dryer (a combination of a washing machine and a dryer). A household appliance may have a treatment chamber, which is designed to receive objects such as textiles and to subject them to a treatment inside the treatment chamber, for example cleaning and/or drying.

The temperature range intended for the treatment chamber of a household appliance during a treatment is approximately 20° C. to 150° C., in particular from about 20° C. to about 75° C. or from about 30° C. to about 60° C. Accordingly, the at least one sensor is designed to operate within the above-mentioned temperature range.

The sensor data may, for example, be at least one parameter of a movement (in particular speed and/or acceleration, in particular of the device and/or of the casing and/or of the treatment chamber), magnetic flux density, conductivity (for example of a substance inside the treatment chamber such as water and/or a washing or cleaning solution or liquor) and/or temperature, for example the temperature in the treatment chamber and/or the temperature of a substance in the treatment chamber such as water. Correspondingly, several sensors may be intended, which are configured for the acquisition of several sets of sensor data, e.g. an acceleration sensor (accelerometer), a magnetic field sensor, a conductivity sensor and/or a temperature sensor (e.g. a thermocouple), just to name a few non-limiting examples. Furthermore, a sensor in the sense of the present subject-matter may be understood to be, for example, a mechanical sensor (e.g. a pressure sensor) and/or an optical sensor (e.g. a CCD sensor).

The evaluation data is, for example, indicative of whether or not a device which may be placed in the treatment chamber of the household appliance and which comprises at least one sensor—hereinafter also referred to as a device—is located in the treatment chamber of the household appliance.

As already briefly explained above, the device may be a device according to the second aspect of the present disclosure. For example, the device is a dosing unit. The device and/or the dosing device comprises in particular the at least one sensor.

The dosing device and/or device is designed to be placed in the treatment chamber of the household appliance and has, in particular, an appropriate size that allows the dosing device and/or device to be at least partially removed from the treatment chamber. In particular, the dosing device and/or the device may be placed loosely and/or without connecting components in the treatment chamber. For example, in the case of a washing machine or dryer, the dosing device or the device is to be placed inside and/or removed from the treatment chamber together with the objects to be cleaned. In particular, a casing of the dosing device or device encloses some or all of the components of the dosing device or device partially or completely. In particular, the casing is designed to be watertight so that some or all of the components do not come into contact with water when the dosing device or the device is placed in a treatment chamber, for example the treatment chamber of a washing machine, and in particular during a treatment.

The device according to the second aspect is in particular a mobile and/or portable device and/or a device different from the household appliance. By a mobile and/or portable device is meant, for example, a device whose external dimensions are smaller than about 30 cm×about 30 cm×about 30 cm, preferably smaller than about 15 cm×about 15 cm×about 15 cm. A device other than a household appliance is, for example, a device that has no functional and/or structural connection with the household appliance and/or is not a part that is permanently connected to the household appliance. For example, a mobile and/or portable device as well as a device that is different from a household appliance shall be understood as a device that is placed (e.g. inserted) by a user in the washing and/or cleaning area—in particular in the treatment chamber—of the household appliance (e.g. the washing drum of a washing machine) for the duration of a treatment process (e.g. cleaning program). An example of such a mobile and/or portable device, which is different from a household appliance, is a dosing device, which is placed in the washing drum of a washing machine before the start of the washing process.

The device and/or the dosing device may have at least one output module which is designed to dispense at least one preparation into the treatment chamber of the household device and/or to trigger an output. The output of a preparation, for example, comprising washing and/or cleaning agents, is to be understood, for example, as meaning that the preparation is output to the environment of the output module and/or a storage container for the preparation. The output is carried out, for example, by the output module. Alternatively or additionally, output may be affected by the output module, e.g. the output module causes the preparation to be output through the storage container. For example, the output module causes the preparation to be output through an output opening of the output module and/or the storage container to the environment of the output module and/or the storage container.

For example, determining the evaluation data may be performed and/or controlled by the device according to the second aspect, whereas the acquisition of the at least one set of sensor data is also performed and/or controlled by this device. Alternatively, determining the evaluation data may be performed and/or controlled by a server or a server cloud. In the latter case, the acquisition of the at least one set of sensor data is performed and/or controlled by a device different from the server or server cloud.

For example, the at least one server is a remote server. This at least one remote server has, for example, a connection to a communication network (e.g. the Internet). Via this communication network, for example, the dosing unit or device may communicate with the server. The communication between the device and the at least one server is in particular bidirectional communication. To enable communication with the server, the communication interface of the device is configured to establish a connection with this communication network (e.g. the Internet).

The storage container data represents a property of a preparation contained in the storage container, such as washing and/or cleaning agents. Such storage container data, which is characteristic of a property of a preparation contained in a storage container, is to be understood, for example, as data which represents and/or contains one or more indications of a chemical and/or physical property of the preparation, of the type of preparation and/or for identification of the preparation. By a chemical and/or physical property is meant, for example, a chemical and/or physical composition of the preparation and/or the physical condition of the preparation (e.g. solid, liquid or gaseous). For example, the storage container data represents values of one or more physical and/or chemical quantities (e.g. one or more values of physical and/or chemical quantities describing one or more properties of the preparation). An indication of a type of preparation comprising a detergent and/or cleaning agent indicates for example whether it is a heavy-duty detergent, a mild detergent, a coloreds detergent, disinfectant and/or another type of detergent and/or cleaning agent and/or which ingredients and/or builder composition the detergent and/or cleaning agent has. An example of an indication for the identification of the preparation is, for example, an identifier for the identification of the preparation such as a product name and/or a product number.

The device and/or the dosing device may, for example, comprise a storage container. This is configured, for example, to contain a preparation (e.g. a certain amount of a detergent and/or cleaning agent). For example, the storage container has one or more storage compartments to hold the preparation. If the storage container has several storage compartments, each of the storage compartments may, for example, contain a different preparation such as a different detergent and/or cleaning product and/or a different mixture of detergents and/or cleaning agents. For example, the storage container may have a specific spatial shape (e.g. cube-shaped, spherical and/or plate-like). For example, the storage container may be at least partially dimensionally stable. Alternatively or additionally, the storage container may, for example, be at least partially flexible, for example as a flexible packaging material (e.g. as a tube and/or a bag). It is understood that the storage container may also be designed as an at least partially flexible container surrounded by an at least partially dimensionally stable receptacle, for example as a bag in a substantially dimensionally stable frame.

The preparation, in particular a washing and/or cleaning agent, is contained in the storage container, for example in solid, liquid and/or gaseous form. For example, the preparation is a pure substance and/or a mixture of substances. A solid preparation, such as a detergent and/or cleaning agent, may be contained in the storage container, for example in powder, tablet and/or tab form. A liquid preparation may, for example, be contained in the storage container as a gel, concentrated and/or diluted solution. It is understood that the preparation may also be contained in the storage container as foam, rigid foam, emulsion, suspension and/or aerosol. Non-exclusive examples of preparations or detergents and/or cleaning agents and/or their ingredients are one or more components from a group of components comprising surfactants, alkalis, builders, graying inhibitors, optical brighteners, enzymes, bleaching agents, soil release polymers, fillers, plasticizers, fragrances, dyes, care substances, acids, starch, isomalt, sugar, cellulose, cellulose derivatives, carboxymethyl cellulose, polyetherimide, silicone derivatives and/or polymethylimines. Other non-exhaustive examples of exemplary ingredients are bleach activators, complexing agents, builders, electrolytes, non-aqueous solvents, pH-adjusting agents, perfume carriers, fluorescent agents, hydrotropes, silicone oils, bentonites, anti-redeposition agents, anti-shrinking agents, anti-crease agents, color transfer inhibitors, antimicrobial agents, germicides, fungicides, antioxidants, preservatives, corrosion inhibitors, anti-static agents, bittering agents, ironing aids, phobic or impregnating agents, swelling or slipping agents and/or UV absorbers.

The condition of the treatment chamber may also be represented by certain evaluation data, which is indicative of the fact that no statement may be made about the (e.g. prevailing) condition of the treatment chamber of the household appliance, since it cannot be determined, for example, whether the acquired sensor data is actually relevant or not for the condition of the treatment chamber of the household appliance. This may be the case, for example, if the acquired sensor data was acquired at a point in time or within a period of time at which the sensor data used to acquire the at least one set of sensor data was not inside the treatment chamber of the household appliance.

The output or the initiation of the output of the evaluation data may trigger control and/or regulation, e.g. dispensing of at least one preparation into the treatment chamber of the household appliance or trigger such output. This may be done in such a way that the household appliance takes the evaluation data into account. Such a cleaning program of the household appliance may, for example, be selected, or an already selected cleaning program of the household appliance may be adapted, which takes into account the load condition of the treatment chamber, if the evaluation data contains or represents corresponding data. For example, a cleaning program that carries out particularly intensive cleaning may be selected if, for example, the treatment chamber is particularly fully loaded.

Alternatively or in addition, a recommendation for a cleaning program to be carried out may, for example, be issued, e.g. via a display device of the household appliance, or issued to an electronic device having or comprising a display device (e.g. a mobile device, such as a smartphone, tablet, or wearable, to name but a few non-limiting examples). On the basis of the output, a user may, for example, manually select an appropriate cleaning program or change an already selected cleaning program (e.g. change the temperature, duration, or other special parameters (e.g. spinning speed of a washing machine-type household appliance, just to name a few non-limiting examples)). This, in particular, makes it possible to use the device with household appliances that cannot be controlled and/or regulated automatically. In this case, the evaluation data is output to the electronic device containing or comprising the display device.

For example, outputting or causing the output of evaluation data may also result in control of the household appliance, such as switching the household appliance on and/or off. With respect to the switching on and/or off of the household appliance, it may be influenced, for example, whether (at all) the household appliance is switched on and/or off and/or at what time (time, date, or e.g. immediately) the household appliance is switched on and/or off. For example, the evaluation data, which is determined at least partially based on the sensor data acquired, may provide such feedback to the household appliance that it knows that, for example, the treatment chamber of the household appliance is fully (or almost fully) loaded. Furthermore, the output or causing the output of the evaluation data may additionally inform the household appliance about the type of load (e.g., laundry, color of the laundry, or a combination thereof, to name only a few non-limiting examples), so that the selection, composition, and/or dosing of a cleaning program to be performed by the household appliance and/or a cleaning agent to be used for the household appliance may be influenced. Thus, for example, the amount to be dosed (e.g. the amount of detergent in a washing machine), the dosing time, the product to be dosed or individual ingredients (e.g. soil release polymers, bleaches, enzymes, hygiene rinse agents in a washing machine, to name but a few non-limiting examples) or combinations thereof may be influenced. The compatibility of combinations of ingredients may also be taken into account to avoid incompatibility (e.g. bleaching agents and enzymes).

Influencing the operating mode of the household appliance may, for example, include selecting a specific (e.g. preprogrammed) program, running additional programs, influencing the program time (e.g. lengthening or shortening), changing individual parameters of the cleaning program (in the case of a washing machine, for example, the temperature, spin speed, or similar).

Additionally or alternatively, it is possible that not only control and/or regulation of the household appliance is automated, but also that the user is given a recommendation by the output or the initiation of the output of the evaluation data. For example, it is possible that in addition to an automated adjustment of the household appliance, manual pretreatment (e.g. of clothes) may be necessary. Such a recommendation may be displayed or communicated to the user by employing a display device—as described above.

According to an exemplary embodiment of all aspects of the present disclosure, the acquired sensor data represents at least partially a progression of the data acquired by the at least one sensor over a predetermined time.

Accordingly, the at least one set of sensor data comprises more than one set of data (e.g. measured values) acquired by the at least one sensor. For example, the at least one sensor may acquire data (e.g. measured values) several times at a predetermined time interval. Alternatively, the at least one sensor may continuously acquire data, e.g. for the duration of a predetermined time interval, e.g. over an interval of e.g. from about 1 to about 10 seconds, from about 2 to about 8 seconds, from about 3 to about 7 seconds, from about 4 to about 6 seconds, or preferably about 5 seconds. It is understood that the interval may deviate from these values if it is reasonable, e.g. the entire duration of a cleaning program carried out by the household appliance or similar.

According to an exemplary embodiment of all aspects of the present disclosure, the at least one sensor is an acceleration sensor and/or a magnetic field sensor.

Furthermore, in the event that the acquired at least one set of sensor data is determined by an acceleration sensor and a magnetic field sensor, the sensor data may include, for example, two independent measurement series. Alternatively, dedicated sensor data from each of the sensors (acceleration sensor and magnetic field sensor) may be determined as first and second sensor data.

An acceleration sensor is a sensor that measures its acceleration. This is done, for example, by determining the inertial force acting on a mass of the acceleration sensor. Thus it may, for example, be determined whether there is an increase or decrease in speed.

Accordingly, the sensor data may in particular include further data acquired by other sensors included in the device (e.g. temperature sensor, optical sensor, conductivity sensor, or a combination of these, to name but a few non-limiting examples).

For example, the sensor data may be determined or acquired by at least one magnetic field sensor. Such a magnetic field sensor is also called a magnetometer. In particular, a magnetic field sensor is a sensor device for measuring magnetic flux densities. Magnetic flux densities are measured in the unit Tesla (T). Such a magnetic field sensor may, for example, be a magnetic field sensor based on MEMS (Micro-Electro-Mechanical System).

According to an exemplary embodiment of all aspects of the present disclosure, the data determined by the acceleration sensor and/or magnetic field sensor is at least partially indicative of motion.

A movement of the device is exemplified, for example, by a movement of the device comprising the acceleration sensor and/or the magnetic field sensor, by a movement path, or a combination thereof, comprising one or more degrees of freedom. For example, the one or more degrees of freedom and/or the motion path may represent a distance covered by the device. For example, the further the distance traveled, the more likely it is that the household appliance has a smaller load. This is possible, for example, because the device may move more with a smaller load, e.g. in a treatment chamber of a washing machine, or the movement of the device is less restricted by laundry in the treatment chamber of the washing machine.

According to an exemplary embodiment of all aspects of the present disclosure, the sensor data determined by the acceleration sensor is acquired by a measurement of an acceleration to which the acceleration sensor is subjected and/or the sensor data determined by the magnetic field sensor is acquired by a measurement of a magnetic flux density measurable at the magnetic field sensor.

For example, an acceleration sensor may represent a motion sensor. A motion sensor of this type may, for example, detect a change in position. For example, a movement may be detected by an acceleration sensor in such a way that, for example, movements are calculated as an integration of detected data (e.g. measured values) from an acceleration sensor. For example, the position of the device may be determined in this way, e.g. in the treatment chamber of the household appliance.

The sensor data acquired by the acceleration sensor represents, for example, an acceleration and/or movement of the device, e.g. inside the treatment chamber of the household appliance. Furthermore, the data acquired by the acceleration sensor represents a certain position of the device, e.g. inside the treatment chamber of the household appliance.

The at least one magnetic field sensor is especially designed to detect changes (even the smallest) relative to the earth's magnetic field as data (e.g. measured value).

According to an exemplary embodiment of all aspects of the present disclosure, the progression represented by the at least one set of sensor data represents a curve as a curve progression, whereby the curve progression is represented over a predetermined time interval.

Such a curve progression is represented in particular by sensor data, which comprises more than one measured value as data. The progression of the curve is generated by mapping at least two measured values over a time axis in a two-dimensional coordinate system, with the amplitude of the measured value being plotted over the y-axis. In this way, points may be determined in the coordinate system. The points mapped in the coordinate system may be connected with each other and/or to each other. The result is a curve progression. The determination of the evaluation data may also be based at least partially on such a curve progression. Further details and features are explained in the following of this general description.

According to an exemplary embodiment of all aspects of the present disclosure, the determination of the evaluation data comprises a determination of one or more characteristic patterns represented by the curve progression.

According to an exemplary embodiment of all aspects of the present disclosure, the one or more characteristic patterns represented by the curve progression represents one or more of the following characteristic patterns i) to iii):

i) harmonious oscillation pattern;

ii) (e.g. uniform or characteristic) pattern of one or more pauses; and (iii) disharmonious oscillation pattern.

The curve progression, for example, represents a progression of a harmonious and/or a disharmonious sinusoidal oscillation. The curve progression represents, for example, a progression of a harmonious and a disharmonious sinusoidal oscillation, for example, by representing a harmonious sinusoidal oscillation over a first period of time and a disharmonious oscillation over a second period of time (e.g. immediately following the first period of time).

If, for example, the determined sensor data represents an essentially uniform harmonious oscillation behavior (e.g. the curve progression represented by the sensor data equals or resembles such an oscillation behavior), this corresponds, for example, to rotating the treatment chamber of the household appliance. If, for example, the magnetic field sensor detects such a curve progression, independent of the spatial axis (e.g. x-, y- and/or z-axis), it may be clearly recognized that the treatment chamber of the household appliance is moving (e.g. a rotation of a washing machine drum). Accordingly, it may be determined that, for example, a cleaning program has been started by the household appliance and the device is definitely located inside the treatment chamber of the household appliance.

If, for example, the determined sensor data represents one or more pauses through which, for example, a uniform harmonious oscillation behavior (e.g. the curve progression equals or resembles such an oscillation behavior) is interrupted, the determined sensor data may be characteristic of a specific cleaning program carried out by the household appliance, so that the cleaning program carried out may be identified. These pauses may, for example, occur at certain intervals, also known as pause behavior, whereby these certain intervals of the pauses are characteristic of one of many possible cleaning programs that may be carried out by the household appliance. Thus, at least partially based on such a pause behavior, an identification (e.g. by employing an analysis and a database query in a so-called look-up table) of the cleaning program performed by the household appliance may be concluded.

According to an exemplary embodiment of all aspects of the present disclosure, frequency data is determined, wherein the frequency data is indicative of a frequency of a rotational movement of the treatment chamber of the household appliance, and wherein the frequency data is determined at least partially based on the detected sensor data.

The frequency data represents, for example, a value in the unit revolutions per minute (in short: rpm). In this way, a spinning speed or other characteristic number of revolutions of the treatment chamber of a household appliance designed as a washing machine, dryer or washer-dryer may be determined. For example, a status of a cleaning program carried out by the household appliance may be determined at least partially based on the frequency data.

For example, in order to determine whether or not a spinning process is taking place as part of a cleaning program carried out by a household appliance designed as a washing machine, or to determine the speed of the treatment chamber (e.g. in a washing machine, washer-dryer and dryer), data determined by the magnetic field sensor may be evaluated. In this case, for example, the rotational speed of the treatment chamber is at least approximately determined or determined (e.g. calculated) based at least in part on the duration of an oscillation amplitude (e.g. from a first zero crossing to a second zero crossing), or a frequency of such oscillation amplitudes, to name only a few non-limiting examples An embodiment according to all aspects of the present disclosure stipulates that the data determined by the acceleration sensor is at least partially indicative of a load condition of the treatment chamber of the household appliance.

The data determined by the acceleration sensor is at least partially indicative of a load condition of the treatment chamber of the household appliance. The data determined by the acceleration sensor represents, for example, whether the treatment chamber of the household appliance is loaded or not. In addition, the data determined by the acceleration sensor may represent how full (e.g. as a percentage of the maximum possible capacity) the treatment chamber of the household appliance is loaded (or filled).

In case the data determined by the acceleration sensor characterizes a relatively frequent movement of the device (e.g. little movement within a time interval, e.g. of about 5 seconds; e.g. more than one movement per second), it is possible to find out that the treatment chamber of the household appliance has a correspondingly small load. If the data determined by the acceleration sensor characterizes a relatively infrequent movement of the device (e.g. only one movement per second), it may be determined that the treatment chamber of the household appliance is fully loaded. In training cases, for example, a slightly loaded and a fully loaded treatment chamber may be present, and the acceleration sensor may be used to acquire corresponding patterns (as data) characterizing the respective condition. These may be stored in a database as reference values, for example. Furthermore, depending on the conditions of the treatment chamber, recommendations for dispensing and/or triggering the output of preparation into the treatment chamber may be defined by the household appliance in the database, for example, to ensure a particularly reliable cleaning result. In addition or alternatively, depending for example on the condition of the treatment chamber of the household appliance, recommendations for the cleaning program to be carried out by the household appliance may be included in the database. The data stored in the database or included in the database may be used, for example, to control both the device and the household appliance.

The curve progression represented by the data may, for example, also be evaluated in such a way that in the case of a household appliance (e.g. a household appliance designed as a washing machine) a filling quantity or a filling level (e.g. as a percentage of the maximum possible filling quantity set at about 100%) of the treatment chamber is determined.

If, for example, there is no harmonious sinusoidal oscillation as a curve progression represented by the sensor data, this behavior is characteristic for a treatment chamber load of less than about 50% of the maximum possible treatment chamber load. With larger load quantities up to about 100% of the maximum possible load quantity of the treatment chamber, the behavior (or movement) of the device changes. This is represented, for example, by the curve progression of the determined sensor data. Inside the treatment chamber, the movement of the device changes, whereby this is represented by the curve progression, which represents the oscillation behavior as a harmonious oscillation (e.g. a sinusoidal curve progression).

According to an exemplary embodiment of all aspects of the present disclosure, control and/or regulation of a further device, in particular the household appliance and/or a device usable in the household appliance, is executed and/or controlled at least partially based on the evaluation data output.

In particular, based on the evaluation data provided, dispensing and/or causing the output of a preparation may be performed and/or prevented.

The control and/or regulation of the device that may be placed in the treatment chamber of the household appliance for dispensing the preparation on the part of the at least one output module is based at least partially on the sensor data. If the acquired sensor data represents, for example, a movement of the treatment chamber, e.g. in a washing machine, the dispensing and/or triggering of the output of the preparation may, for example, be prevented until there is no (longer) movement of the treatment chamber. Further possible scenarios are, for example, that a movement of the device has been detected based on the acquired sensor data, but not, for example, a further rotation of the device relative to the movement of the treatment chamber, e.g. in a washing machine. This may indicate, for example, that the device is wrapped in a load (e.g. laundry) in the treatment chamber of the washing machine. Similarly, the dispensing and/or triggering of the output of the preparation may also be inhibited until the device is no longer wrapped up, for example, since this allows, in particular, improved dispensing and/or triggering of the output of the preparation.

For example, the output module comprises a control unit and at least one actuator, wherein the control unit is configured to control the actuator. For example, the control unit is configured to control the actuator in such a way that a movement of the actuator is affected. For example, the movement of the actuator causes a preparation to be dispensed. For example, the control unit is configured to control the actuator in such a way that the preparation is dispensed in accordance with the output parameters specified by the output control data and/or the output of the preparation contained in the storage container (e.g. by the storage container) is effected in accordance with the output parameters specified by the output control data. The control unit is controlled and/or regulated, for example, based on the output evaluation data.

An actuator is to be understood as a movable component of the output module. For example, the actuator is configured in such a way that, when it moves and the storage container is connected to the output module, it causes the preparation to be dispensed. Examples of an actuator are a pump (e.g. a peristaltic pump), a valve and/or a motor (e.g. a linear motor). If the actuator is a pump, the control unit controls the pump for outputting the preparation, for example, in such a way that the pump transports the preparation from the storage container to an output opening (e.g. an output opening of the storage container and/or the output module). If the actuator is a valve, the valve is configured, for example, to close an output opening (e.g. an output opening of the storage container and/or the output module). To output the preparation, the control unit controls the valve, for example, so that the valve opens so that the preparation may flow out of the output opening.

According to an exemplary embodiment of all aspects of the present disclosure, the evaluation data is at least partially indicative of a placement of a device comprising the at least one sensor and usable in the treatment chamber of the household appliance inside this treatment chamber of the household appliance.

Whether the device is placed inside the treatment chamber of the household appliance or not may be determined by employing the curve progression represented by the sensor data, as already explained above.

Alternatively or additionally, it may be determined by location data, for example, whether the device is located inside the treatment chamber of the household appliance or not. The location data may, for example, be acquired as data from a GPS sensor or the like. Since the data acquired by a GPS sensor that represents the specific location may be inaccurate, it is possible to alternatively or additionally determine the signal attenuation of a communication signal (e.g. WLAN signal). If the device is placed inside the treatment chamber of the household appliance, received communication signals are attenuated. Such data may, for example, be acquired by a communication module that is included in the device, to give just one non-limiting example.

According to an exemplary embodiment of all aspects of the present disclosure, the evaluation data is at least partially indicative of a status of the treatment chamber of the household appliance.

The status of the treatment chamber of the household appliance is exemplified, for example, by a cleaning program carried out by the household appliance. For example, such a cleaning program carries out different cleaning steps, whereby the individual cleaning steps differ from each other, for example, by physical and/or chemical parameters. To give just a few non-limiting examples, a physical parameter may be indicative of whether or not movement of the treatment chamber takes place. For example, a chemical parameter may be indicative of whether or not a preparation is dosed to treat objects placed in the treatment chamber of the household appliance. For example, the preparation may be dosed in one cleaning step in order to clean the objects placed in the treatment chamber as efficiently as possible. On the other hand, only water may be present in the treatment chamber in a further cleaning step, for example to rinse textiles with clear water that were previously cleaned with the preparation.

In an arrangement according to all aspects of the present disclosure, the data determined by the acceleration sensor is at least partially indicative of a status of a cleaning program carried out by the household appliance.

The status of the cleaning program performed by the household appliance represents, for example, an identification of the status of the cleaning program that corresponds, for example, to the current and performed step of the cleaning program by the device. This may, at least in part, be based on the data determined by the acceleration sensor or on several sets of data determined by the acceleration sensor, which reflect or include one or more parameters exemplifying the condition of the treatment chamber of the household appliance. A parameter exemplifying the condition of the treatment chamber of the household appliance also represents, for example, temperature, liquid level (e.g. water), and number of revolutions of the treatment chamber of a household appliance designed as a washing machine, to name only a few non-limiting examples.

At least partially based on the determined status of the cleaning program executed by the household appliance, it is possible, for example, to control and/or regulate the device or to determine a possible control and/or regulation of the device that is intended to be executed. For example, control and/or regulation of the device may be carried out or possible control and/or regulation of the device intended for execution may be determined, at which point in time (date, time, step of the cleaning program, or similar) dispensing or triggering outputting preparation (e.g. cleaning agent), a consideration of the nature and/or type (e g manufacturer and device identification number) of the household appliance, and/or whether or not dispensing or triggering outputting preparation (e.g. cleaning agent) should take place when a step of the cleaning program (e.g. turning of the treatment chamber in a household appliance designed as a washing machine) should take place or not.

For this purpose, for example, a query may be made to a database that is stored in a memory (locally in the device, or centrally, e.g. in a server) in which, for example, historical data is stored. On the basis of this historical data, for example, the control and/or regulation of the device may be performed or possible control and/or regulation of the device intended for execution may be determined. The use of historical data may, in particular, be combined with the use of an artificial neural network. Further details on the use of an artificial neural network are given in the general description below.

For example, according to the first aspect of the present disclosure, the method comprises acquiring and/or obtaining sensor data characteristic of the condition of a treatment chamber of the household appliance and determining and/or effecting the determination of evaluation data at least partially dependent on the sensor data. The sensor data represents, for example, measured values of one or more physical and/or chemical variables which are characteristic of the condition of the treatment chamber and/or the device, for example of the washing and/or cleaning process, such as a temperature of the washing and/or cleaning liquor, a duration of the washing and/or cleaning process and/or a concentration of washing and/or cleaning agents in the washing and/or cleaning liquor.

According to an exemplary embodiment of all aspects of the present disclosure, the determination of the evaluation data is performed by employing an artificial neural network.

For example, the sensor data may be communicated (e.g. transmitted) to a server that comprises an artificial neural network or is connected to it. Determining the evaluation data, which is indicative of whether or not the device that may be placed in the treatment chamber of the household appliance is located in the treatment chamber of the household appliance, may then be determined using the artificial neural network. The result may then be communicated to the device and/or the household appliance.

The artificial neural network includes, for example, an evaluation algorithm, so that, for example, training cases may be learned from as examples and these may be generalized after the learning phase as a basis for determining a result. This means that the examples are not simply applied, but patterns and regularities in the learning data are recognized. Different approaches may be followed for this purpose. For example, supervised learning, partially supervised learning, unsupervised learning, reinforced learning and/or active learning may be used. Supervised learning may, for example, be carried out using an artificial neural network (e.g. a recurrent neural network) or a support vector machine. Unsupervised learning may also be performed by employing an artificial neural network (e.g. an auto encoder). The learning data are, for example, sensor data received several times or the output variables (or results) of the artificial neural network determined after one cycle.

It is also possible that the repeated receipt and/or determination of sensor data or output variables are used for machine learning. For example, a user profile or one or more sets of the data contained in the user profile may be determined at least partially based on machine learning.

These measures may increase the reliability of the determination of the evaluation data, on the basis of which, for example, control and/or regulation of the device and/or the household appliance and subsequently, in particular, the treatment by the household appliance, in particular for the removal of soiling, may take place.

Each of the training cases may be given, for example, by an input vector, sensor data and an output vector of the artificial neural network.

Each training case of the training cases may, for example, be generated by converting the evaluation data associated with the training case and dispensing or triggering of the output of a preparation in the treatment chamber of the household appliance into a predetermined condition (e.g. defined soiling in the treatment chamber of the household appliance), and then generating sensor data representative of sensor data characteristic of the condition of the treatment chamber, and at the same time performing an analysis of the condition of the treatment chamber of the household appliance, e.g. manually. The determined sensor data is transmitted as an input vector, the (actual) condition from the treatment chamber of the household appliance as an output vector of the training case.

The evaluation data may, for example, comprise one or more output parameters for the device. Examples of an output parameter are an output quantity, an output time, output temperature and/or output duration. For example, an output parameter specifies an output quantity, an output time, output temperature and/or output duration for the output. The fact that evaluation data is configured to at least partially control the output through the output module shall be understood as meaning that evaluation data causes the output module to dispense the preparation according to the output parameters specified by the evaluation data. For example, the output module of the device is configured to dispense the preparation contained in the storage container according to the output parameters specified by the evaluation data and/or to cause the output of the preparation contained in the storage container (e.g. by the storage container) according to the output parameters specified by the evaluation data when the storage container is connected to the output module.

Determining the evaluation data at least partially dependent on the storage container data shall mean, for example, that the evaluation data is selected and/or calculated at least partially dependent on the storage container data.

It is also disclosed that an acceleration sensor and/or a magnetic field sensor is used in a dosing device, in particular a device according to the first aspect of the present disclosure for a household appliance, wherein the acceleration sensor is configured to acquire sensor data characteristic of the condition of the treatment chamber of the household appliance and/or the device, and wherein the sensor data at least partially represents data determined by the at least one acceleration sensor. The acceleration sensor or the device comprising the acceleration sensor may be designed according to individual or several features described above.

In particular, the previous or following description of method steps according to preferred embodiments of a method should also reveal corresponding features for carrying out the method steps by preferred embodiments of a device. Likewise, by the disclosure of employing a device for performing a method step, the corresponding method step shall also be disclosed.

Further advantageous exemplary embodiments of the present disclosure are shown in the continuing detailed description of some exemplary embodiments of the present disclosure, especially in connection with the Figures. The Figures, however, are only intended to clarify, but not to determine the scope of protection of the present disclosure. The Figures are not to scale and are merely intended to illustrate the general concept of the present disclosure. In particular, features included in the Figures are not intended to be considered as a necessary element of the present disclosure. The Figures, even though described above, are also described below to clarify the subsequent discussion.

Figure 2:
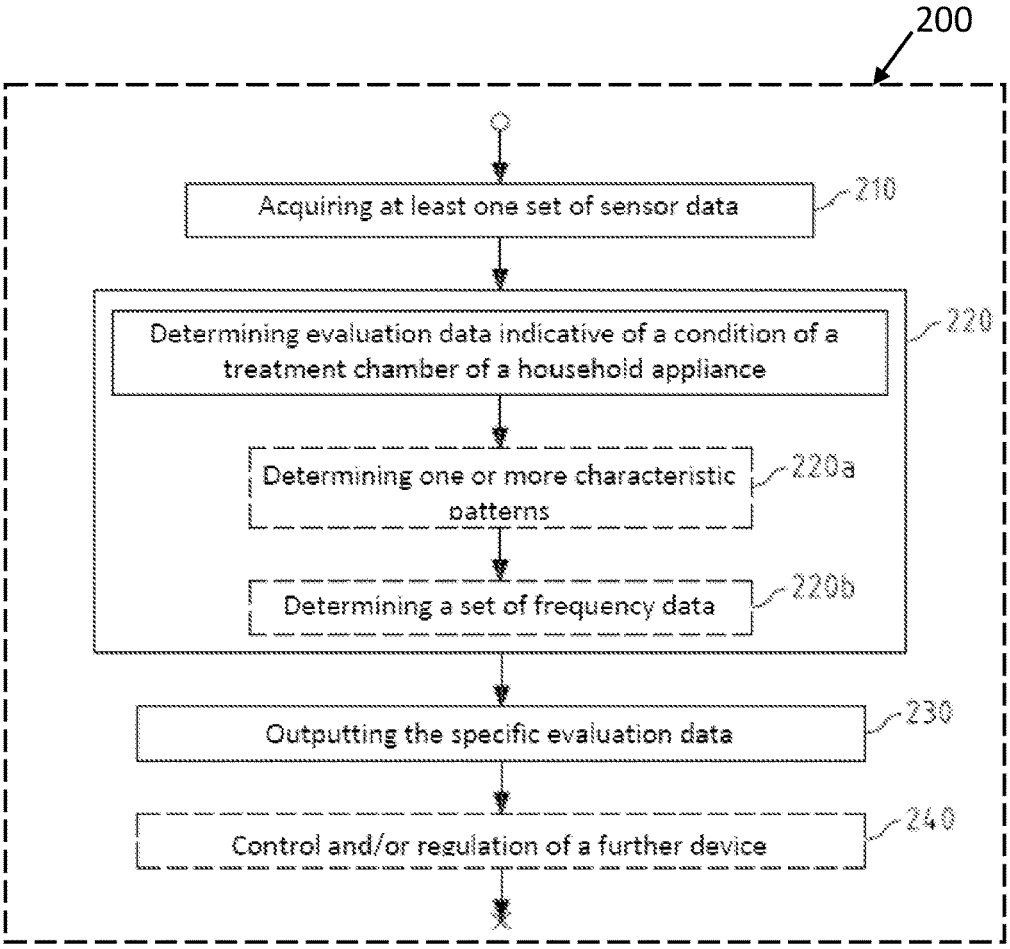
FIG. 2 shows a flowchart of an exemplary embodiment according to a method based on the first aspect of the present disclosure, as carried out e.g. by a dosing unit 100 according to FIG. 1.
Figure 3:
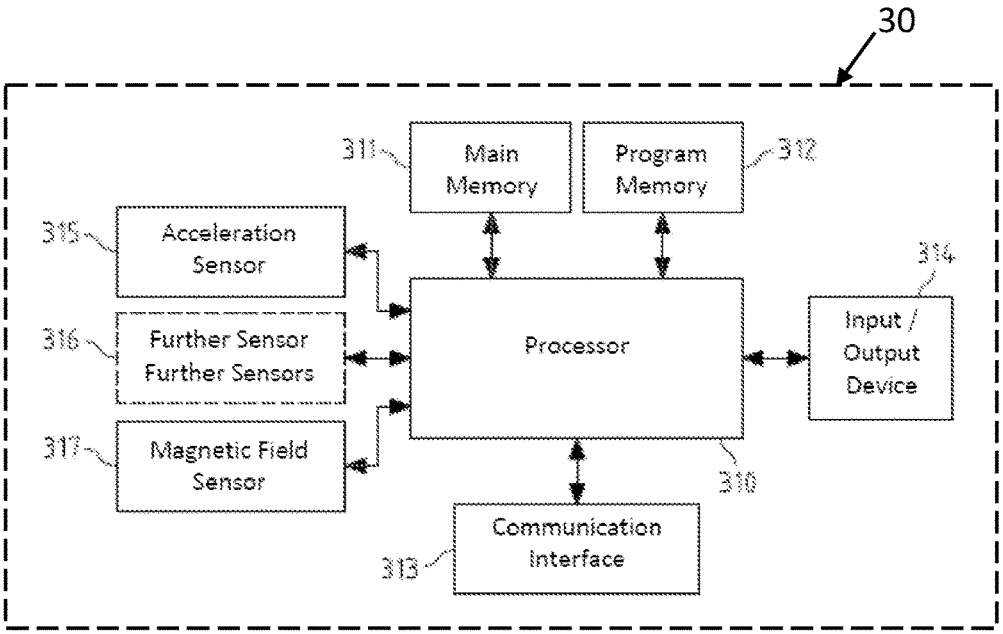
FIG. 3 shows a block diagram of an exemplary embodiment according to a method according to the second aspect of the present disclosure, e.g. a dosing device 100 according to FIG. 1.
Figure 4A:
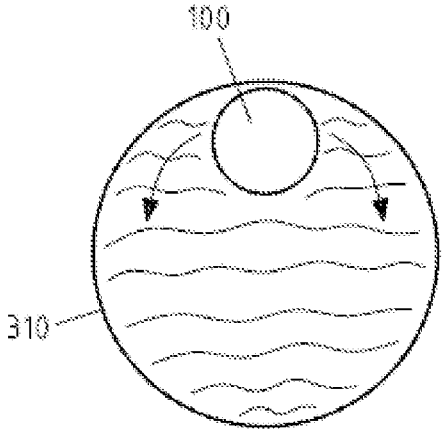
FIG. 4*a* shows a device 100 (e.g. device 100 according to FIG. 1) schematically in a condition placed in a treatment chamber 310 (e.g. a drum) of a household appliance (e.g. household appliance 300 according to FIG. 1)
Figure 4B:
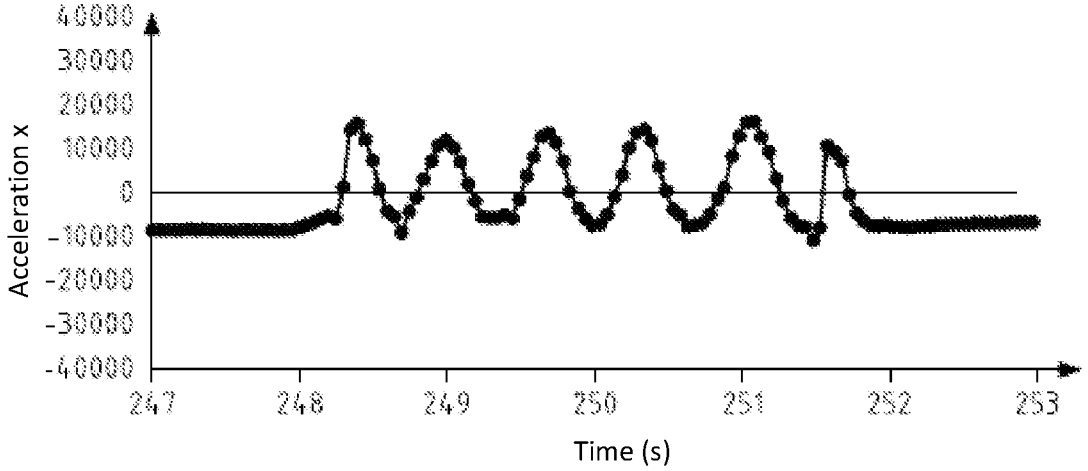
FIG. 4*b* shows a first set of sensor data determined by an acceleration sensor, e.g. comprised by a device 100 according to FIG. 1, which in this case represents an acceleration curve as a curve progression.
Figure 5A:
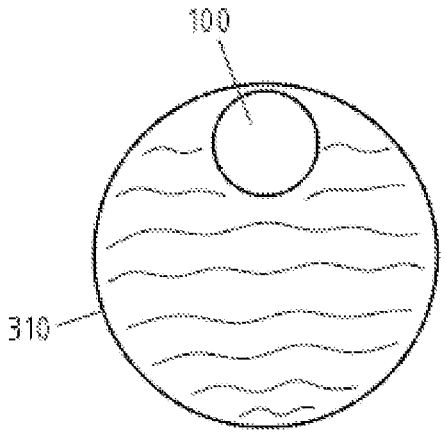
FIG. 5*a* shows a device 100 (e.g. device 100 according to FIG. 1) schematically in a condition placed in a treatment chamber 310 (e.g. a drum) of a household appliance (e.g. household appliance 300 according to FIG. 1) before a wetting phase of a cleaning program to be carried out by the household appliance.
Figure 5B:
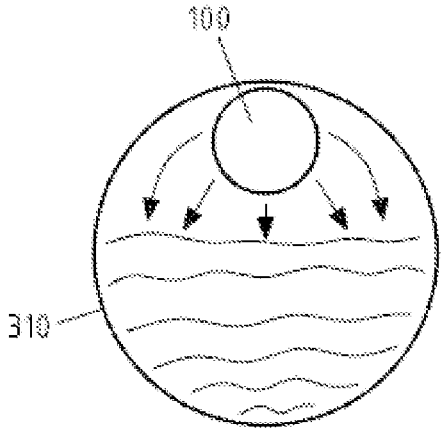
FIG. 5*b* shows a device 100 (e.g. device 100 according to FIG. 1) schematically in a condition placed in a treatment chamber 310 (e.g. a drum) of a household appliance (e.g. household appliance 300 according to FIG. 1) after or during a wetting phase of a cleaning program to be performed by the household appliance.
Figure 5C:
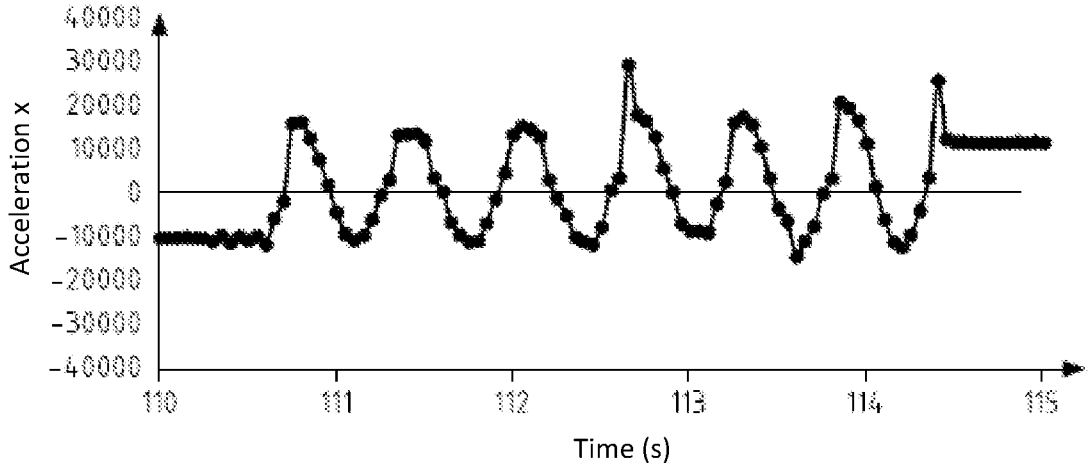
FIG. 5*c* shows a second set of sensor data determined by an acceleration sensor, e.g. included in a device 100 according to FIG. 1, which in this case represents an acceleration curve as a curve progression.
Figure 5D:
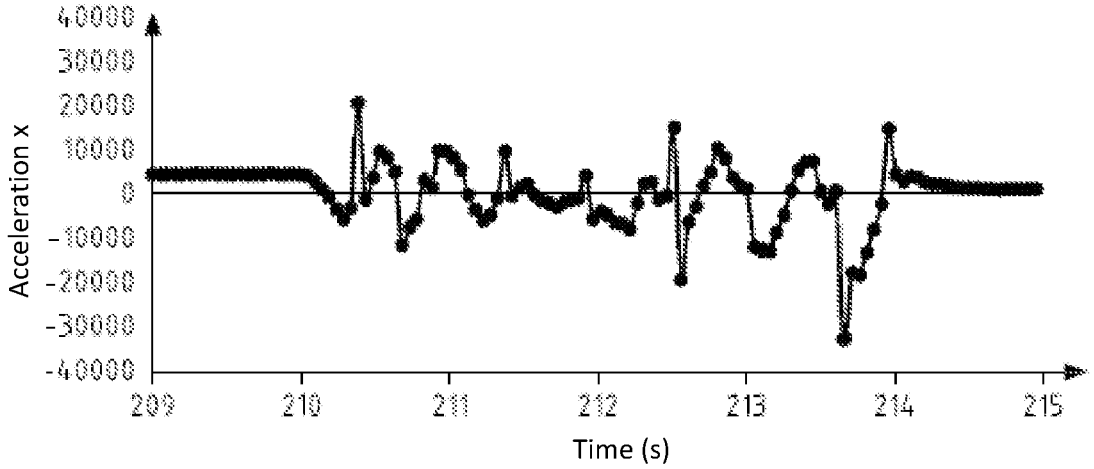
FIG. 5*d* shows a third set of sensor data determined by an acceleration sensor, e.g. included in a device 100 according to FIG. 1, which in this case represents an acceleration curve as curve progression.
Figure 6A:
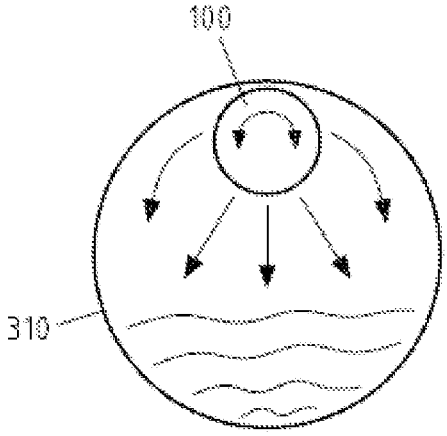
FIG. 6*a* shows a device 100 (e.g. device 100 according to FIG. 1) schematically in a condition placed in a treatment chamber 310 (e.g. a drum) of a household appliance (e.g. household appliance 300 according to FIG. 1)
Figure 6B:
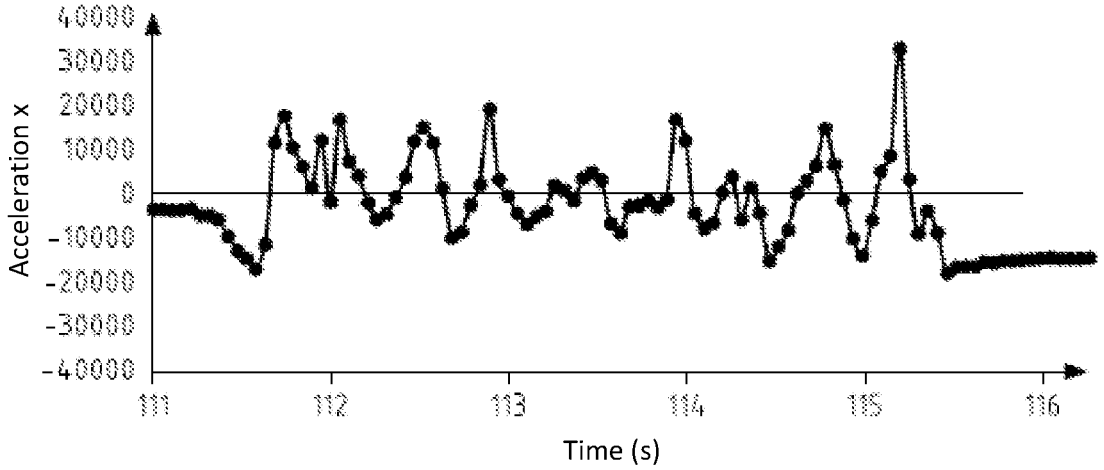
FIG. 6*b* shows a fourth set of sensor data determined by an acceleration sensor, e.g. included in a device 100 according to FIG. 1, which in this case represents an acceleration curve as a curve progression.
Figure 7A:
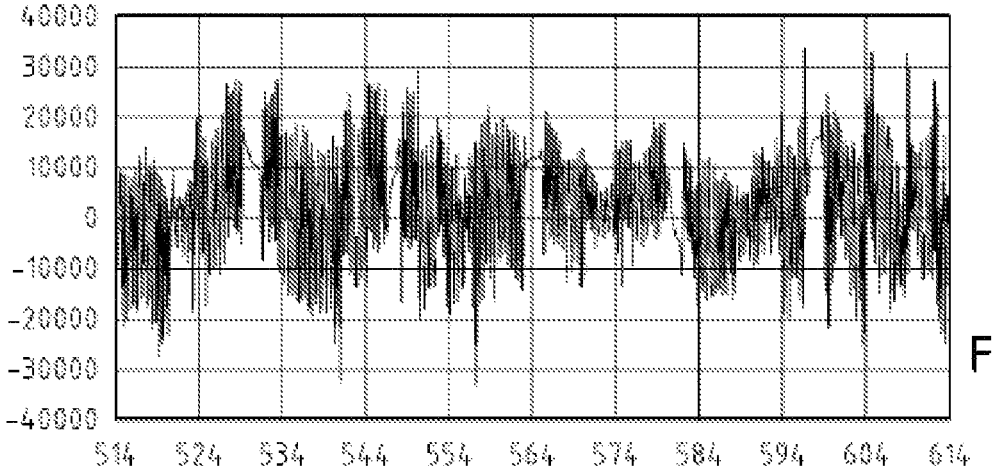
FIG. 7*a* shows a schematic curve progression of determined sensor data for a full load of the treatment chamber of a household appliance (e.g. household appliance 300 according to FIG. 1)

FIG. 1 shows a schematic representation of an embodiment of a system as contemplated herein;

FIG. 2 shows a flowchart of an exemplary embodiment according to a method based on the first aspect of the present disclosure, as carried out e.g. by a dosing unit 100 according to FIG. 1;

FIG. 3 shows a block diagram of an exemplary embodiment according to a method according to the second aspect of the present disclosure, e.g. a dosing device 100 according to FIG. 1;

FIG. 4*a* shows a device 100 (e.g. device 100 according to FIG. 1) schematically in a condition placed in a treatment chamber 310 (e.g. a drum) of a household appliance (e.g. household appliance 300 according to FIG. 1);

FIG. 4*b* shows a first set of sensor data determined by an acceleration sensor, e.g. comprised by a device 100 according to FIG. 1, which in this case represents an acceleration curve as a curve progression;

FIG. 5*a* shows a device 100 (e.g. device 100 according to FIG. 1) schematically in a condition placed in a treatment chamber 310 (e.g. a drum) of a household appliance (e.g. household appliance 300 according to FIG. 1) before a wetting phase of a cleaning program to be carried out by the household appliance;

FIG. 5*b* shows a device 100 (e.g. device 100 according to FIG. 1) schematically in a condition placed in a treatment chamber 310 (e.g. a drum) of a household appliance (e.g. household appliance 300 according to FIG. 1) after or during a wetting phase of a cleaning program to be performed by the household appliance;

FIG. 5*c* shows a second set of sensor data determined by an acceleration sensor, e.g. included in a device 100 according to FIG. 1, which in this case represents an acceleration curve as a curve progression;

FIG. 5*d* shows a third set of sensor data determined by an acceleration sensor, e.g. included in a device 100 according to FIG. 1, which in this case represents an acceleration curve as curve progression;

FIG. 6*a* shows a device 100 (e.g. device 100 according to FIG. 1) schematically in a condition placed in a treatment chamber 310 (e.g. a drum) of a household appliance (e.g. household appliance 300 according to FIG. 1);

FIG. 6*b* shows a fourth set of sensor data determined by an acceleration sensor, e.g. included in a device 100 according to FIG. 1, which in this case represents an acceleration curve as a curve progression;

FIG. 7*a* shows a schematic curve progression of determined sensor data for a full load of the treatment chamber of a household appliance (e.g. household appliance 300 according to FIG. 1)

Figure 7B:
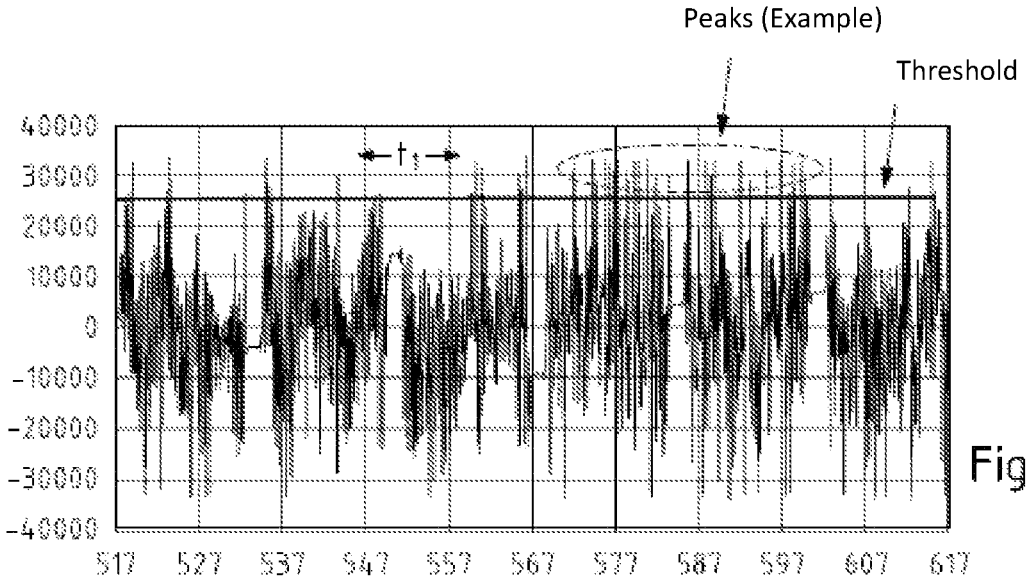
FIG. 7*b* shows a schematic curve progression of determined sensor data for an average load of the treatment chamber of a household appliance (e.g. household appliance 300 according to FIG. 1)
Figure 7C:
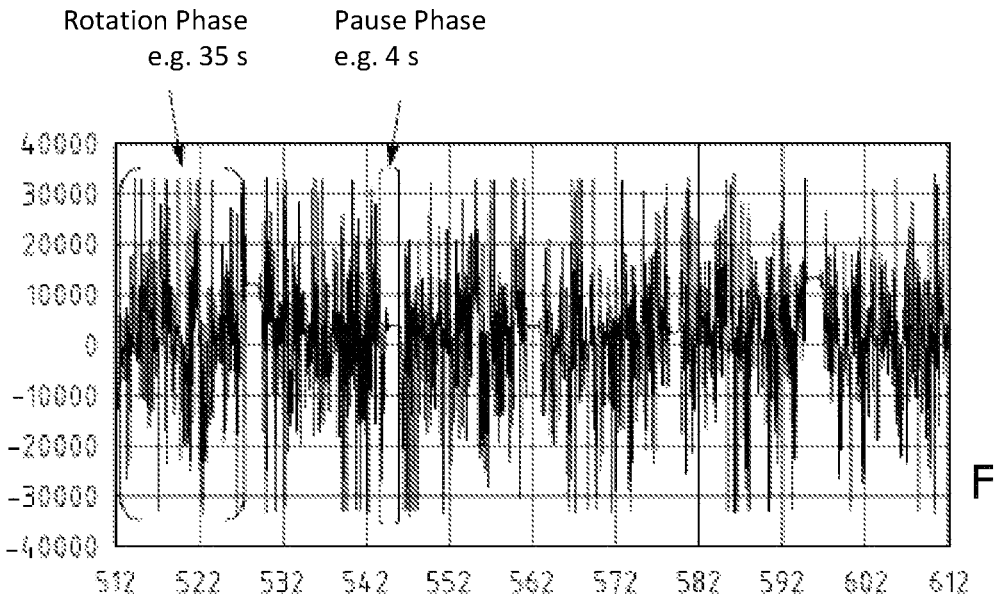
FIG. 7*c* shows a schematic curve progression of determined sensor data for a small load of the treatment chamber of a household appliance (e.g. household appliance 300 according to FIG. 1)
Figure 8:
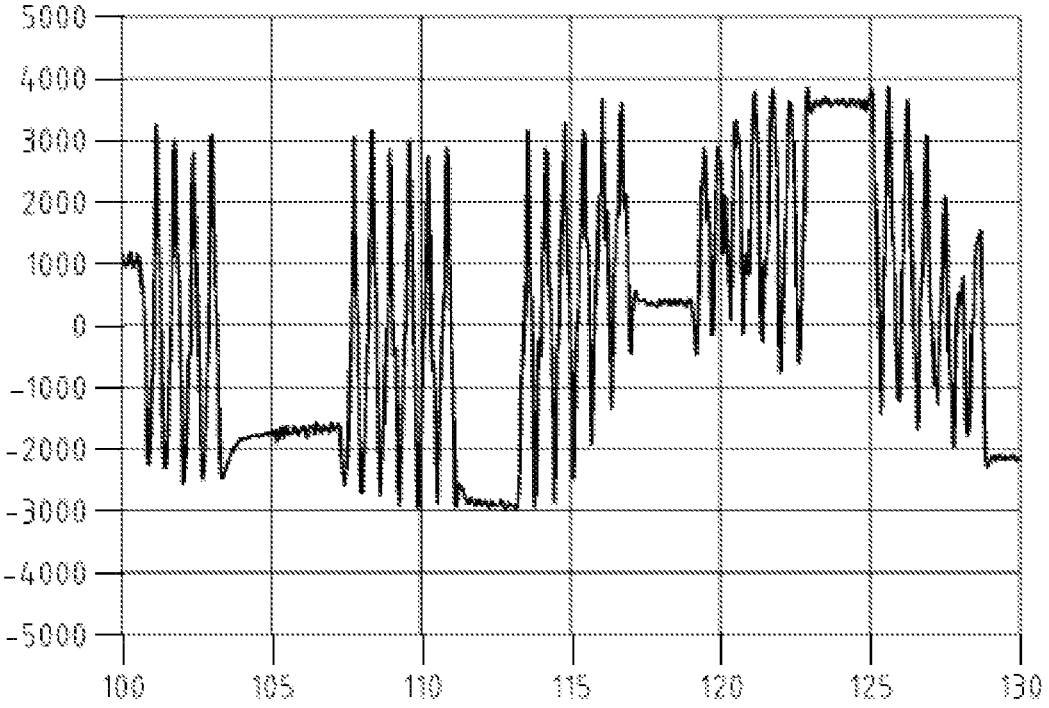
FIG. 8 shows a first set of sensor data determined by a magnetic field sensor, e.g. included in a device 100 according to FIG. 1, which in this case represents a curve progression.
Figure 9:
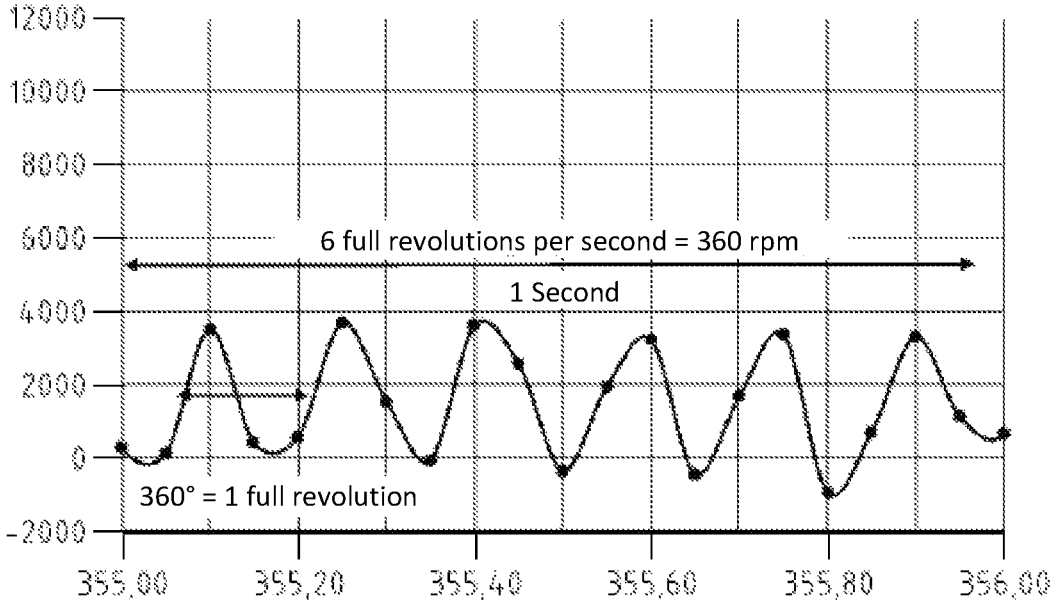
FIG. 9 shows a second set of sensor data determined by a magnetic field sensor, e.g. included in a device 100 according to FIG. 1, which in this case represents a curve progression.
Figure 10:
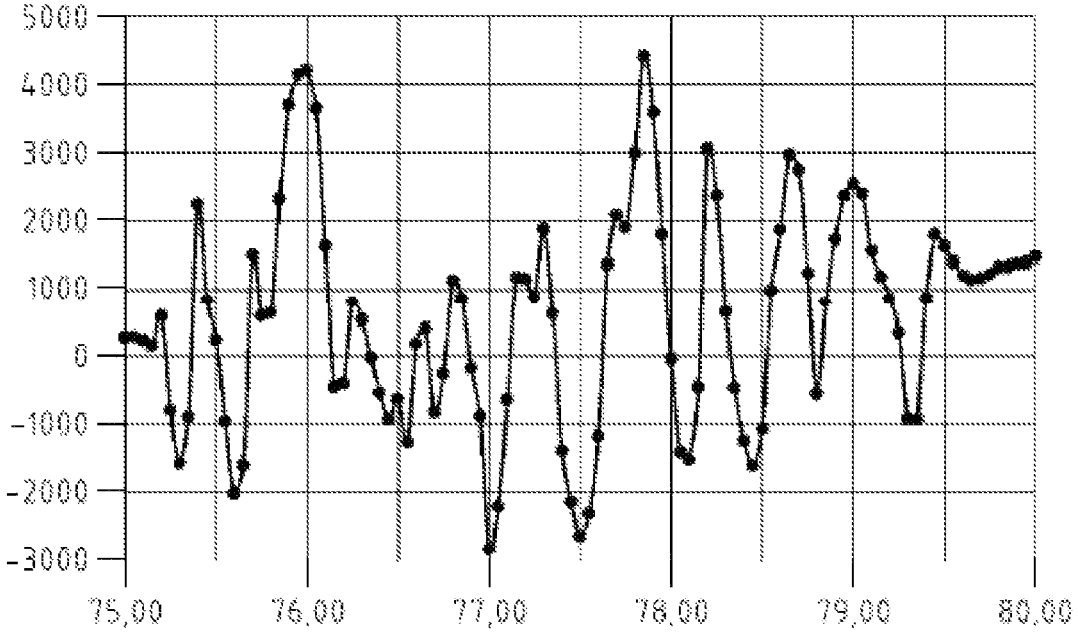
FIG. 10 shows a third set of sensor data determined by a magnetic field sensor, e.g. included in a device 100 according to FIG. 1, which in this case represents a curve progression.
Figure 11:
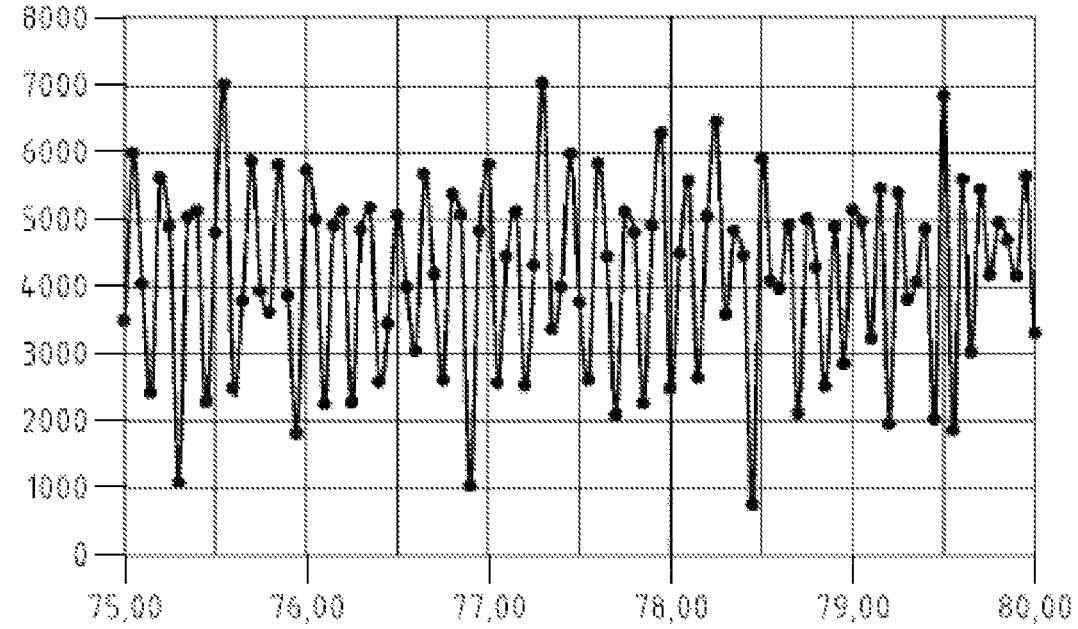
FIG. 11 shows a fourth set of sensor data determined by a magnetic field sensor, e.g. included in a device 100 according to FIG. 1, which in this case represents a curve progression.

FIG. 7*b* shows a schematic curve progression of determined sensor data for an average load of the treatment chamber of a household appliance (e.g. household appliance 300 according to FIG. 1);

FIG. 7*c* shows a schematic curve progression of determined sensor data for a small load of the treatment chamber of a household appliance (e.g. household appliance 300 according to FIG. 1);

FIG. 8 shows a first set of sensor data determined by a magnetic field sensor, e.g. included in a device 100 according to FIG. 1, which in this case represents a curve progression;

FIG. 9 shows a second set of sensor data determined by a magnetic field sensor, e.g. included in a device 100 according to FIG. 1, which in this case represents a curve progression;

FIG. 10 shows a third set of sensor data determined by a magnetic field sensor, e.g. included in a device 100 according to FIG. 1, which in this case represents a curve progression; and FIG. 11 shows a fourth set of sensor data determined by a magnetic field sensor, e.g. included in a device 100 according to FIG. 1, which in this case represents a curve progression.

FIG. 1 shows first of all a schematic representation of an embodiment of a System 1 according to the third aspect of the present disclosure comprising the devices 100, 200, 300 and 400. System 1 is configured to execute exemplary methods according to the first aspect of the present disclosure. Device 100 is an exemplary mobile device 100 (for example a dosing device), which in this case may be placed in the treatment chamber 310 of the household appliance 300 (here exemplarily configured as a washing machine). Device 100 may be a device according to the second aspect of the present disclosure. Furthermore, System 1 comprises as a further device mobile device 200 in the form of a smartphone, tablet, wearable, or the like (here exemplarily configured as a smartphone). Mobile device 200 may also be a device according to the second aspect of the present disclosure or may perform and/or control individual steps of exemplary methods according to the first aspect of the present disclosure. However, device 200 may also be a computer, a desktop computer or a portable computer, such as a laptop computer, a tablet computer, or a Personal Digital Assistant (PDA). In addition or alternatively to device 200, the system may include a server 400. Server 400 may be a device according to the second aspect of the present disclosure or may execute and/or control individual steps of exemplary methods according to the first aspect of the present disclosure. It is also conceivable that System 1 also comprises less or more than three devices, but at least two devices.

While the examples described here are described in particular in connection with household appliance 300 in the form of a washing machine, the explanations also apply analogously to other types of household appliances.

Each of the devices 100, 200, 300, 400 may have a communication interface to communicate and/or to exchange data with one or more of the other devices, e.g. directly via a wireless (Bluetooth, WLAN, ZigBee, NFC, to name but a few non-limiting examples) and/or wired (LAN) connection, and/or via a communication network 118, such as the Internet, and/or a local network covering the devices 100, 200, 300.

FIG. 2 presents a flowchart 200 of an exemplary embodiment according to a method according to the first aspect of the present disclosure, which may be executed in the context of the present disclosure. The method is executed, for example, by a metering device 100 or a device 100 according to FIG. 1, which may, for example, be designed as device 30 of FIG. 3.

In a first step 210 at least one set of sensor data is acquired. Acquisition (e.g. measurement) is performed, for example, by employing a sensor which is included in device 30 or which may be connected alternatively or additionally to device 30.

In a second step 220, evaluation data indicative of a condition of a treatment chamber of a household appliance is determined, such as the treatment chamber 310 of the household appliance 300 according to FIG. 1. The evaluation data is determined at least partially based on the at least one set of sensor data acquired in step 210 (e.g. calculated by an artificial neural network).

In a step 220*a*, optionally included in step 220, one or more characteristic patterns are determined, which may be included in a curve progression represented by the at least one sensor data, which represents measured values included in the at least one set of sensor data. This determination of the one or more characteristic patterns may, for example, comprise an analysis step in which a comparison is made with known characteristic patterns. These known characteristic patterns may, for example, be one or more of the following patterns, which may be represented by the curve progression:

(i) harmonious oscillation pattern;

ii) (e.g. uniform) pattern of one or more pauses; and (iii) disharmonious oscillation pattern.

The known characteristic patterns may, for example, be stored in a memory (e.g. in a database). Based on one or more characteristic patterns determined in the curve progression, a condition (of the treatment chamber) may be inferred from the household appliance. For example, a filling level of objects to be treated may be determined, which are placed in the treatment chamber of the household appliance. Furthermore, a status of a cleaning program executed by the household appliance may be determined, for example, which phase and/or which step of the cleaning program is currently (momentarily) executed by the household appliance, to name just a few non-limiting examples.

In step 220*b*, which is optionally included in step 220, frequency data is determined, for example, indicative of a movement of the treatment chamber of the household appliance. For example, the determined frequency data indicates a spinning speed with which laundry (as objects) is spun in the treatment chamber (as a drum) of the household appliance (in this example, a washing machine). Correspondingly, the frequency data is indicative, for example, of such a rotational speed of the treatment chamber of the household appliance, whereby the treatment chamber performs a corresponding rotational movement. A condition (of the treatment chamber) of the household appliance may also be inferred, at least in part based on the frequency data. Furthermore, for example, a status of a cleaning program performed by the household appliance may be determined at least partially based on the specific frequency data.

In the event that in step 220*a* and/or step 220*b* a determination of one or more characteristic patterns and/or frequency data has been performed and/or controlled, the determined patterns and/or frequency data may be included in the evaluation data, or alternatively or additionally taken into account in determining the evaluation data. Consequently, the determination of the evaluation data may further be based at least partially on the determined one or more characteristic patterns and/or on the determined frequency data.

In a third step 230, an output or an initiation of the output of the specific evaluation data is performed, e.g. to household appliance 300 according to FIG. 1, to mobile device 200 according to FIG. 1, and/or to server 400 according to FIG. 1. The output may, for example, be performed via the communication network 118 according to FIG. 1. Furthermore, the output may first be sent to another entity other than household appliance 300, mobile device 200, and/or server 400, whereby this entity forwards the output evaluation data to the household appliance 300, the mobile device 200, and/or the server 400.

In an optional fourth step 240, a further device is controlled and/or regulated at least partially based on the evaluation data output in step 230. The further device may be, for example, household appliance 300, mobile appliance 200, and/or dosing device 100, which has itself occasionally determined the evaluation data.

In case the optional step 240 is not executed and/or controlled, the flow chart ends after step 230.

For example, steps 220*a* and 220*b*, if executed and/or controlled, may be executed and/or controlled in parallel. Alternatively, steps 220*a* and 220*b* may be executed and/or controlled sequentially, that is, one after the other, whereby the sequence of steps 220*a* and 220*b* does not matter.

FIG. 3 now shows a block diagram 30 of an exemplary embodiment of a device as contemplated herein for performing an exemplary embodiment of a method as contemplated herein. Block diagram 30 according to FIG. 3 may be used as an example for device 100 shown in FIG. 1, washing machine 300 shown, the mobile device 200 (or part of it) shown, or server 400 shown.

Processor 310 of device 30 is designed in particular as a microprocessor, micro-controller unit, micro-controller, Digital Signal Processor (DSP), Application-Specific Integrated Circuit (ASIC) or Field Programmable Gate Array (FPGA).

Processor 310 executes program instructions stored in program memory 312 and stores, for example, intermediate results or the like in the working or main memory 311. Program memory 312 is, for example, a non-volatile memory such as a flash memory, a magnetic memory, an EEPROM memory (Electrically Erasable Programmable Read-Only Memory) and/or an optical memory. Main memory 311 is, for example, a volatile or non-volatile memory, in particular a Random Access Memory (RAM) such as a Static RAM memory (SRAM), a Dynamic RAM memory (DRAM), a Ferroelectric RAM memory (FeRAM) and/or a Magnetic RAM memory (MRAM).

Program memory 312 is preferably a local data storage medium firmly connected to device 30. Data storage media permanently connected to device 30 is, for example, hard disks which are built into device 30. Alternatively, the data storage medium may, for example, also be a data storage medium that is detachably connectable to device 30.

Program memory 312 contains, for example, the operating system of device 30, which is at least partially loaded into main memory 311 when the device 30 is started and is executed by processor 310. In particular, when device 30 is started, at least part of the core of the operating system is loaded into main memory 311 and executed by processor 310.

In particular, the operating system allows the use of device 30 for data processing. For example, it manages resources such as main memory 311 and program memory 312, communication interface 313, optional input and output device 314, provides basic functions to other programs through programming interfaces and controls the execution of programs.

Processor 310 further controls communication interface 313, which may, for example, be a network interface and may be designed as a network card, network module and/or modem. Communication interface 313 is configured in particular to establish a connection of device 100 with other devices, in particular via a (wireless) communication system, for example a network, and to communicate with them. Communication interface 313 may, for example, receive data (via the communication system) and forward it to processor 310 and/or receive data from processor 310 and send it (via the communication system). Examples of a communication system are a local area network (LAN), a wide area network (WAN), a wireless network (e.g. according to the IEEE 802.11 standard, the Bluetooth (LE: Low Energy Standard) and/or the NFC standard), a wired network, a mobile network, a telephone network and/or the Internet. For example, communication is possible with the Internet and/or other devices using the communication interface 313. In the case of devices 200, 300, 400, communication interface 313 may be used to communicate with the other devices 200, 300, 400 or the Internet and/or via the Internet.

Such a communication interface 313 may in particular be used to acquire (e.g. receive) sensor data exemplifying the condition of a treatment chamber of a household appliance (e.g. washing machine 300 according to FIG. 1). Furthermore, the displayed components (and other components if required) may be used to control and/or regulate a household appliance (e.g. washing machine 300 according to FIG. 1) and/or the device (e.g. device 100 according to FIG. 1), taking into account the received sensor data.

Furthermore, processor 310 may control at least one input/output device 314. Input/output device 314 is, for example, a keyboard, a mouse, a display unit, a microphone, a touch-sensitive display unit, a loudspeaker, a reader, a drive and/or a camera. For example, input/output device 314 may receive input from a user and forward it to processor 310 and/or receive and output data for the user from processor 310.

Finally, device 30 may include at least one acceleration sensor 315, at least one magnetic field sensor 317, and optionally one or more additional sensors 316. One of the one or more further sensors is, for example, a GPS module, in order to obtain location data of the corresponding device. Another example of a further sensor 316 is a temperature sensor, a conductivity sensor, and/or an optical sensor, in order to obtain temperature data, conductivity data, and/or optical data.

FIG. 4*a* shows a device 100 (e.g. device 100 according to FIG. 1) schematically in a condition placed in a treatment chamber 310 (e.g. a drum) of a household appliance (e.g. household appliance 300 according to FIG. 1). Household appliance 300 is designed as a washing machine. The treatment chamber 310 of the washing machine is loaded to its full capacity (corresponding to about 100% load). This is shown schematically by the indicated curved and horizontally extending lines in treatment chamber 310. An acceleration sensor contained in device 100 (e.g. acceleration sensor 315 of device 30 as shown in FIG. 3) is activated when it detects a change in movement behavior according to its sensitivity. This is the case as soon as the drum of treatment chamber 310 rotates, regardless of whether it is used to determine the weight or to distribute the incoming water. In this load situation, however, device 100 may not or only very little move in the direction of all possible spatial directions. Device 100 is virtually blocked and therefore rotates with the frequency of the drum. This condition is maintained even during the so-called wetting phase—corresponding to water intake—of a cleaning program carried out by household appliance 300. This may, for example, result in a very characteristic progression of sensor data determined by the acceleration sensor, which in this case represents an acceleration curve as a curve progression over time. This curve is shown in FIG. 4*b*. The progression essentially corresponds to a harmonious sinusoidal oscillation corresponding to the rotational movement of the drum. Accordingly, such a determined acceleration curve as curve progression is indicative for a fully loaded drum, if, for example, it is determined during water intake.

FIGS. 5*a* and 5*b* each show a device 100 (e.g. device 100 according to FIG. 1) schematically in a condition placed in a treatment chamber 310 (e.g. a drum) of a household appliance (e.g. household appliance 300 according to FIG. 1). Household appliance 300 is designed as a washing machine. The treatment chamber 310 of the washing machine is filled in such a way that the treatment chamber 310 appears full to a user. This is shown schematically by the indicated curved and horizontally extending lines in treatment chamber 310. The drum is therefore only apparently filled to its full capacity. The drum is not filled to the extent that objects to be cleaned, e.g. laundry, have been stuffed into the drum. At the beginning of a cleaning program, device 100 moves only slightly, corresponding to a limited free space. This is shown in FIG. 5*a*. The acceleration curve or the curve progression of the acceleration curve represented by sensor data acquired by an acceleration sensor included in device 100 (e.g. acceleration sensor 315 of device 30 according to FIG. 3) corresponds to that of a harmonious sine wave (cf. FIG. 5*c*, see also FIG. 4*b*). With increasing water intake, the laundry collapses somewhat and new free space is created in the drum, for example. Now device 100 may move freely in this newly freed space and no longer exclusively follows the movement of the drum (cf. FIG. 5*b*). The progression of the sine curve is disturbed and finally disharmonious (cf. FIG. 5*d*).

Such behavior is, for example, typical for a partially loaded drum. In this case it is therefore important not only to observe the curve behavior as such, but to evaluate the change in curve behavior over time. For this purpose, certain analysis methods are suitable, for example, those based on graphical and/or mathematical principles. For example, sensor data representing the curve progression may be examined or analyzed for their zero points and/or the distance of the zero points from each other when determining the evaluation data. For example, a disharmonious function constantly changes the distance between its zeros. A further possibility to examine for disharmony is the determination of amplitude maxima (+) or amplitude minima (−). Here, for example, the result of the above analysis should ideally be identical to the result of the equation.

If, for example, a curve progression shown in FIG. 5*d*, represented by the acquired sensor data, is determined, e.g. during a water intake process in the context of a cleaning program to be carried out, it may be assumed, for example, that the treatment chamber 310 of the household appliance 300, represented by the determined evaluation data, has an average load quantity.

FIG. 6*a* shows a device 100 (e.g. device 100 according to FIG. 1) schematically in a condition placed in a treatment chamber 310 (e.g. a drum) of a household appliance (e.g. household appliance 300 according to FIG. 1). Household appliance 300 is designed as a washing machine. The treatment chamber 310 of the washing machine is filled in such a way that only a small quantity of items (e.g. laundry) is placed in the treatment chamber. This is shown schematically by the indicated curved and horizontally extending lines in treatment chamber 310. From the beginning, device 100 may move freely in the treatment chamber 310 (the drum). Only if the centrifugal forces, e.g. caused by rotation of the drum of the washing machine, hold device 100 in position, does correspondingly determined sensor data (cf. above description) or the acceleration curve depicted by it as a curve progression represent an approximately sinusoidal acceleration progression. Typically, however, the progression is disharmonious from the beginning (cf. FIG. 6*b*). In contrast to the examples shown in FIGS. 4*a, b* and 5*a* to *c*, FIG. 6*b* shows that at no point during the water intake process of a cleaning program to be carried out does a harmonious acceleration behavior occur (e.g. represented by a progression of the acceleration curve of the sensor data corresponding to a harmonious sinusoidal oscillation). If, therefore, a clear disharmonious acceleration behavior is detected at the beginning, it must be assumed that there is a small load inside treatment chamber 310. This is represented accordingly by the specific evaluation data.

In a further exemplary embodiment according to all aspects, the device is designed or configured to determine sensor data (e.g., acquired by the acceleration sensor (e.g., an acceleration sensor 315 of the device 30 according to FIG. 3) during a water intake phase of a cleaning program to be carried out by household appliance 300) as a basis for determining weight data, which is then included in the evaluation data, indicative of a quantity of objects placed in the treatment chamber 310 of household appliance 300. At least partially based on the determined weight data, for example, quantity data indicative of a quantity of detergent to be dosed may be determined. For example, a predetermined matrix comprising detergent quantities associated with different weight data may be used to determine the detergent quantity. Furthermore, in a step following the determination of the detergent quantity, for example, it may be determined whether or not the water intake of the cleaning program to be performed has ended and/or whether or not the actual cleaning process (e.g., washing process) has begun. This may be done, for example, on a (further) evaluation of the sensor data representing the acceleration progression as a curve progression and in the context of determining the evaluation data.

FIG. 7*a* shows a schematic curve progression for a full load of the treatment chamber (e.g. treatment chamber 310 according to FIG. 1) of a household appliance (e.g. household appliance 300 according to FIG. 1). FIG. 7*b* shows a schematic curve progression for an average load of the treatment chamber 310 of a household appliance 300. FIG. 7*c* shows a schematic curve progression for a small load of the treatment chamber 310 of a household appliance 300. The curves of FIGS. 7*a* to 7*c* are acquired over a longer period of time, in this case about 3 minutes, and as part of a cleaning program carried out by the household appliance.

This results in movement patterns that are exemplified by regular movement phases (corresponds to a rotation of the drum) and pause phases. This movement pattern is evaluated by the appliance (e.g. device 100 according to FIG. 1) after passing through the water intake phase. If such a regular pattern is detected several times (e.g. with n pattern≥3), device 100 interprets this as a washing process and device 100 doses a first detergent (e.g. portion of detergent) e.g. from its storage container. The detergent portion may be divided into further sub portions. The dosing may also be made dependent on further parameters, e.g. a detected temperature rise, e.g. represented by the sensor data.

In case the load detection has not been carried out in the steps described above, device 100 determines weight data indicative of a quantity of objects placed in the treatment chamber 310 of the household appliance 300, e.g. by employing a further detection algorithm in which the number of peak maxima (amplitude maxima) above a threshold value is evaluated over a period of time t1 (cf. FIG. 7*b*). The number of peak maxima correlates inversely with the load quantity. This means that the more peak maxima are detected, the smaller the load. By introducing limit values, load ranges, e.g. "average load", may be defined here as well.

In a second embodiment, the device may provide feedback to the process via a non-wired connection, for example to a communication device. This may happen immediately or with a time delay. A feedback may, for example, be a confirmation of the load recognition or an indication of the load quantity (e.g. the weight of laundry). Dose confirmations or dose quantities of cleaning agent stored by the device may also be reported, e.g. to a server (e.g. server 400 according to FIG. 1). By employing bidirectional communication the user may, for example, via a voice-controlled system, confirm the feedback or carry out corrections to the dosing process.

In a further embodiment according to all aspects, a (dosing) system comprises the electro-mechanical system according to the third aspect of the present disclosure itself and an API (Application Programming Interface). The API serves the universal multi-directional connection of other software systems to the software of the device. The active use of the API by other software, for example one for the operation, monitoring and control of a household appliance (e.g. a washing machine), occasionally considerably extends the functionality of the system. In addition to the mutual exchange of pure data, control commands may also be transmitted in one direction as well as in the other. This enables the device to take over the control of a household appliance designed as a washing machine, for example, and make adjustments to the cleaning program, such as time adjustments depending on the load of the treatment chamber of the household appliance. This may be advantageous if a user starts a standard program with normal duration that is actually intended for full loads, but the device has only detected a partial load. For a partial load, however, the full duration is not required due to the higher mechanical input. It may therefore be shortened and the user gets his laundry back in less time. Conversely, if, for example, the user starts a program with a short duration but the load is too high, the device may extend the duration and thus ensure that the laundry is still clean. In addition to influencing the duration of the program, the device may also respond simply by changing the amount of the detergent (e.g. detergent quantities) according to a dosing matrix stored in a database to match the load quantities. It is advisable to store such a dosing matrix locally on a memory contained in the device, since during cleaning (or washing) it cannot always be ensured that the device may establish and/or maintain contact with a local or external server via communication, e.g. by employing the communication interface contained in the device (e.g. WLAN, BLE, LPWAN, Sub GHz etc.).

FIG. 8 shows sensor data determined by a magnetic field sensor encompassed by a metering device (e.g. device 100 according to FIG. 1) or its curve progression. The curve represented by the sensor data was determined for a household appliance designed as a washing machine (e.g. household appliance 300 according to FIG. 1), the drum of which (e.g. treatment chamber 310 according to FIG. 1) was fully loaded (i.e. with max. filling quantity; 100%). It can be seen that a uniform, harmonious vibration behavior (corresponding to a rotation of the drum, e.g. in the context of a cleaning program carried out by the washing machine) is represented by the curve. If such a curve is detected by the magnetic field sensor, regardless of the spatial axis (e.g. x-, y- and/or z-axis), it is clearly possible to determine or recognize that the drum is rotating and a washing or drying process has been started. With this data acquired over a certain time (period), the determined sensor data may also be associated with a point in time (e.g. a time stamp). According to, for example, a dosing matrix, a corresponding detergent may be dosed by the dosing device.

Furthermore, the curve shown in FIG. 8 also clearly shows breaks in movement. The drum stands still and accordingly the metering unit does not move relative to the drum or not at all. These pauses may occur at certain intervals, which are also referred to as pause behavior, whereby these certain intervals are characteristic of many cleaning programs of a household appliance (in this case the washing machine) and may thus serve to identify via respective characteristic patterns (e.g. by employing an analysis and a database query in a so-called look-up table, executed in the context of determining the evaluation data) the cleaning program carried out by the household appliance.

FIG. 9 shows sensor data determined by a magnetic field sensor, which is included in a dosing device (e.g. device 100 according to FIG. 1), or its curve progression. The curve represented by the sensor data was determined for a household appliance designed as a washing machine (e.g. household appliance 300 according to FIG. 1), whereby only one third of the drum (e.g. treatment chamber 310 according to FIG. 1) was loaded (e.g. with 2 kg of laundry from a max. load of 6 kg, to name just one non-limiting example).

For example, in order to determine whether a spin cycle is taking place as part of a cleaning program carried out by the washing machine, or to determine the rotational speed of the treatment chamber, the sensor data determined by the magnetic field sensor may be evaluated to determine this. This is not possible with sensor data being acquired by an acceleration sensor, for example, because the centrifugal forces are too high and exceed the measuring range of the acceleration sensor. For example, in a conventional washing machine with a load volume of about 6 kg of laundry (e.g. with a drum diameter of about 47 cm), an acceleration of about 42 G is achieved at a spinning speed of about 400 rpm, and about 378 G at about 1200 rpm. This cannot be measured by acceleration meters based on MEMS. A magnetic field sensor such as a MEMS-based magnetometer, on the other hand, is capable of detecting even the smallest changes relative to the earth's magnetic field. This makes it possible to detect any speed in a washing machine or dryer. In addition to determining the absolute speed, a change in speed may also be determined.

In FIG. 9, for example, it can be seen that a harmonic sinusoidal oscillation clearly correlates with the speed of the drum. The time window shown in FIG. 9 is about 1 second, whereby the curve was determined with a sampling rate of about 20 Hz. A certain sampling rate is required for a correct determination and thus a determination (e.g. calculation) of the speed of the drum, because only with a sufficient amount of information (e.g. amount of data), especially higher speeds of the drum may be clearly determined. For example, to determine one full revolution of the drum, at least two, preferably three, and particularly preferably four measured values of the data determined should be acquired at regular intervals. For example, at a speed of about 1600 rpm, a value of about 26.667 revolutions of the drum per second is available. Consequently, it is possible to reliably describe a sinusoidal curve resulting from a drum speed of about 1600 rpm at a sampling rate of, for example, at least about 50 Hz, preferably up to at least about 110 Hz.

FIG. 10 shows data determined by a magnetic field sensor, which is included in a dosing unit (e.g. device 100 according to FIG. 1), or its curve progression. The curve represented by the data may, for example, also be evaluated in such a way that, in the case of a household appliance designed as a washing machine (e.g. household appliance 300 according to FIG. 1), the degree of filling (e.g. in %) is determined.

The curve shown in FIG. 10 was determined based on a treatment chamber being configured as a drum with a maximum possible load capacity of about 6 kg load with about 2 kg load in the course of a main wash cycle of a cleaning program at approx. 50 to 55 rpm. The cleaning program was carried out by a household appliance designed as a washing machine (e.g. household appliance 300 according to FIG. 1).

The dosing device (e.g. device according to FIG. 1) moves freely in the drum of the washing machine. There is no harmonic sinusoidal oscillation. This behavior is characteristic for a load of less than about 50% of the maximum possible load of the drum. With larger load quantities up to about 100% of the maximum possible load quantity of the drum, the behavior (or movement) of the dosing unit inside the drum changes and the oscillation behavior becomes harmonious, whereby this is represented, for example, by a sinusoidal curve.

FIG. 11 shows further sensor data determined by a magnetometer, e.g. comprised by a device 100 according to FIG. 1, which in this case represents a curve. The curve shown in FIG. 11 was determined on the basis of a treatment chamber being configured as a drum with a maximum possible load capacity of about 6 kg of laundry with this maximum load (presently about 6 kg of laundry) in the course of a main wash cycle of a cleaning program at about 50 to about 55 rpm. The cleaning program was carried out by a household appliance designed as a washing machine (e.g. household appliance 300 according to FIG. 1). It can be seen that in comparison to FIG. 10 a change towards a sinusoidal (harmonic) curve has taken place.

Although sensor data determined in this way does not enable an exact determination of the load quantity of a treatment chamber of a household appliance at least partially based on a device that may be placed in the treatment chamber, the determined sensor data is nevertheless indicative, for example, in order to adapt a dosage of preparation to the load quantity in the treatment chamber. This may be determined accordingly in the context of determining the evaluation data. Furthermore, the determined sensor data may be combined with further sensor data, e.g. determined by one or more further sensors included in the device (e.g. device 100 according to FIG. 1), e.g. with sensor data determined by an acceleration sensor, in order to secure, confirm or correct the determined data of the magnetic field sensor, or to correlate both sensor data with each other.

The exemplary embodiments of the present disclosure described in this specification and the optional features and properties mentioned in each case should also be understood as disclosed in all combinations. In particular, unless explicitly stated otherwise, the description of a feature included in an example of an embodiment shall not be understood in the present case to mean that the feature is indispensable or essential for the function of the example. The sequence of the method steps described in this specification in the individual flowcharts is not mandatory; alternative sequences of the method steps are conceivable. The method steps may be implemented in various ways, for example, implementation in software (through program instructions), hardware or a combination of both to implement the method steps is conceivable.

Terms used in the Claims such as "comprising", "having", "containing", "containing" and the like do not exclude further elements or steps. The expression "at least partially" covers both the "partially" case and the "completely" case. The wording "and/or" should be understood to mean that both the alternative and the combination should be disclosed, i.e. "A and/or B" means "(A) or (B) or (A and B)". The use of the indefinite article does not exclude a plural. A single device may perform the functions of several units or devices mentioned in the Claims. Reference marks indicated in the Claims should not be regarded as limitations of the features and steps used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A method performed by a dosing unit for placement within a treatment chamber of a washing machine, comprising:

acquiring at least one set of acceleration data, wherein the at least one set of acceleration data is acquired by a sensor within the dosing unit during a rotational operation of the treatment chamber of the washing machine, wherein the at least one set of acceleration data at least partially represents a progression of the acceleration data determined by the sensor over a predetermined time interval, wherein the acceleration data is indicative of a movement of the dosing unit within the treatment changer of the washing machine, wherein the progression represented by the at least one set of acceleration data maps a curve as a curve progression, and wherein the curve progression is mapped over the predetermined time interval;

determining evaluation data indicative of a load condition of the treatment chamber of the treatment chamber of the washing machine, wherein the evaluation data is determined in response to the at least one set of acceleration data, one or more characteristic patterns mapped by the curve progression and comparing the curve progression with a known characteristic pattern associated with a known rotational movement of the treatment chamber of the washing machines; and dispensing a preparation into the treatment chamber of the washing machine in response to the specific evaluation data.

2. The method according to claim 1, wherein the at least one sensor comprises an acceleration sensor and/or a magnetic field sensor.

3. The method according to claim 2, wherein the evaluation data determined by the acceleration sensor and/or magnetic field sensor is at least partially indicative of a movement.

4. The method according to claim 2, wherein the at least one set of acceleration data acquired by the acceleration sensor is acquired by a measurement of an acceleration to which the acceleration sensor is subjected, and wherein the at least one set of acceleration data determined by the magnetic field sensor is acquired by a measurement of a magnetic flux density which is measurable at the magnetic field sensor.

5. The method according to claim 1, wherein the one or more characteristic patterns represented by the curve progression represents one or more of the following characteristic patterns i) to iii);

i) a harmonious oscillation pattern;

ii) a pattern of one or more pauses; and (iii) a disharmonious oscillation pattern.

6. The method according to claim 5, wherein the determination of the one or more characteristic patterns comprises comparing the curve progression with known characteristic patterns.

7. The method according to claim 1, wherein the at least one set of acceleration data is characteristic of a particular cleaning program performed by the household appliance so that the particular cleaning program performed may be identified.

8. The method according to claim 1, further comprising determining frequency data, wherein the frequency data is indicative of a frequency of a rotational movement of the treatment chamber of the household appliance, and wherein the frequency data is determined at least partially based on the at least one set of acceleration data.

9. The method according to claim 1, further comprising: controlling and/or regulating a further device at least partially based on the evaluation data.

10. The method according to claim 1, wherein the evaluation data is at least partially indicative of a placement of a device comprising the at least one sensor and usable in the treatment chamber of the household appliance inside the treatment chamber of the household appliance.

11. The method according to claim 1, wherein the evaluation data is at least partially indicative of a status of the treatment chamber of the household appliance.

12. The method according to claim 1, wherein the evaluation data is at least partially indicative of a load condition of the household appliance.

13. The method according to claim 1, wherein determining the evaluation data is performed by an artificial neural network.

14. A device which is configured for executing and/or controlling a method according to claim 1.

* * * * *